US011030942B2

(12) United States Patent
Li et al.

(10) Patent No.: US 11,030,942 B2
(45) Date of Patent: Jun. 8, 2021

(54) BACKPLANE ADAPTABLE TO DRIVE EMISSIVE PIXEL ARRAYS OF DIFFERING PITCHES

(71) Applicant: Jasper Display Corp., Hsinchu (TW)

(72) Inventors: Bo Li, Santa Clara, CA (US); Kaushik Sheth, Los Altos, CA (US)

(73) Assignee: JASPER DISPLAY CORPORATION, Grand Cayman (KY)

( * ) Notice: Subject to any disclaimer, the term of this patent is extended or adjusted under 35 U.S.C. 154(b) by 0 days.

(21) Appl. No.: 16/679,861

(22) Filed: Nov. 11, 2019

(65) Prior Publication Data

US 2020/0098307 A1 Mar. 26, 2020

Related U.S. Application Data

(63) Continuation-in-part of application No. 16/152,559, filed on Oct. 5, 2018, now Pat. No. 10,629,153.

(60) Provisional application No. 62/758,824, filed on Nov. 12, 2018, provisional application No. 62/571,839, filed on Oct. 13, 2017.

(51) Int. Cl.
*G09G 3/32* (2016.01)

(52) U.S. Cl.
CPC ..... *G09G 3/32* (2013.01); *G09G 2310/0272* (2013.01); *G09G 2310/0289* (2013.01)

(58) Field of Classification Search
CPC ..... G09G 3/3685; G09G 3/3233; G09G 3/32; G09G 2300/0452; G09G 2300/0857; G09G 2310/0272; G09G 2310/0289
See application file for complete search history.

(56) References Cited

U.S. PATENT DOCUMENTS

2009/0115703 A1* 5/2009 Cok ..... G09G 3/3233 345/76

OTHER PUBLICATIONS

Ong, "Modern MOS Technology: Processes, Devices and Design", 1984, pp. 207-209, (SRAM), 230-231, (Current Sources), 1984, McGraw-Hill, New York, USA.)
"2114A 1024 x 4 Bit Static RAM", Component Data Catalog, Intel Corp., 1982. Santa Clara, CA, USA.

* cited by examiner

*Primary Examiner* — Lisa S Landis
(74) *Attorney, Agent, or Firm* — WPAT, PC

(57) ABSTRACT

A backplane operative to drive an array of emissive elements forming a part of a display or display like manufacturing device is disclosed. Each emissive element is mounted to a common pad supplied with current from a plurality of pixel drive elements, wherein each pixel drive element is controlled by a resident memory cell. The plurality of pixel drive elements is organized into a block similar to other blocks of pixel drive elements across the array. The common pad may be driven by a larger or lesser number of pixel drive elements than are present in a single block of pixel drive elements. If not needed, specific pixel drive elements present in a single block may be disabled through a mask change.

6 Claims, 15 Drawing Sheets

| | | | |
|---|---|---|---|
| (0,0) | (1,0) | (2,0) | (3,0) |
| (0,1) | (1,1) | (2,1) | (3,1) |
| (0,2) | (1,2) | (2,2) | (3,2) |
| (0,3) | (1,3) | (2,3) | (3,3) |

360

FIG. 3A

BACKPLANE ADAPTABLE TO DRIVE EMISSIVE PIXEL ARRAYS OF DIFFERING PITCHES

CROSS-REFERENCE TO RELATED APPLICATIONS

This application is a Continuation-in-Part of U.S. patent application Ser. No. 16/152,559, "Backplane Suitable to Form Part of an Emissive Pixel Array and System and Methods of Modulating Same," filed on Oct. 5, 2018, which claims the benefit of U.S. Provisional Patent Application 62/571,839, filed on Oct. 13, 2017. This application claims the benefit of U.S. Provisional Patent Application Ser. No. 62/758,824, filed on Nov. 12, 2018.

FIELD OF THE INVENTION

The present invention relates to the design of a backplane useful to drive an array of pixels comprising emissive display elements at each pixel and to a display fabricated with such a backplane. More particularly, the present invention relates to a backplane designed such that it can be adapted to drive light emitting diodes of differing sizes by changing a single metal layer.

BACKGROUND OF THE INVENTION

Emissive displays have proved useful for a variety of applications. For example, plasma display panels (PDPs) were at one time the leading flat panel display technology. More recently, applications that are not display oriented have been postulated, including use as a pixilated emissive device in an additive manufacturing device and use as a component within an illumination system for automotive applications.

More recently, emissive display system developers have demonstrated emissive displays based on backplanes driving small LEDs with a pitch between adjacent pixels of 17 micrometers (hereafter microns or μm) or less. For applications requiring higher brightness the small LEDs may be made larger although still small—on the order of 40 to 50 microns. The sizes stated are not limiting on this specification. These small LEDs are commonly termed microLEDs or μLEDs. LEDs take advantage of the band gap characteristic of semiconductors in which use of a suitable voltage to drive the LED will cause electrons within the LED to combine with electron holes, resulting in the release of energy in the form of photons, a feature referred to as electroluminescence. Those of skill in the art will recognize that semiconductors suitable for LED applications may include trace amounts of dopant material to facilitate the formation of electron holes. Organic light emitting diodes or OLEDs are another example of a class of emissive devices.

The choice of semiconductor materials to form an LED will vary by application. In some applications for visual displays one monochrome color may be desirable, resulting in the use of a single semiconductor material for the LEDs of all pixels. Some LEDs provide white light by using blue light to illuminate a phosphor material suitable to provide green and red light, which, combined with the blue light, is perceived as white in color. In other applications, a full range of colors may be required, which will result in a requirement for three or more semiconductor materials configured to radiate, for example, red, green and blue or combinations thereof. An illumination system based on LEDs may be applied to use in a variety of application, including motor vehicle lights and head lamps. In the case of additive manufacturing, a semiconductor material may be selected such that it emits radiation at a wavelength that acts as actinic radiation on a material used in an additive manufacturing process.

All potential variations are included within the scope of the present invention.

SUMMARY OF THE PRESENT INVENTION

It is therefore an object of the present invention to improve on an array of emissive elements by providing a backplane that can be adapted to emissive elements of a variety of differing sizes by changing as few as one metal layer of the backplane design and a via mask, thereby minimizing development costs while adapting to a variety of differing applications. It is an object of the present invention to improve further the performance of an array of emissive elements by controlling the current to the emissive elements over a wide range of temperatures.

BRIEF DESCRIPTION OF THE DRAWINGS

FIG. 3A is a diagram of a 4×4 block of pixel circuits.

DETAILED DESCRIPTION OF THE INVENTION

Figure 1A:
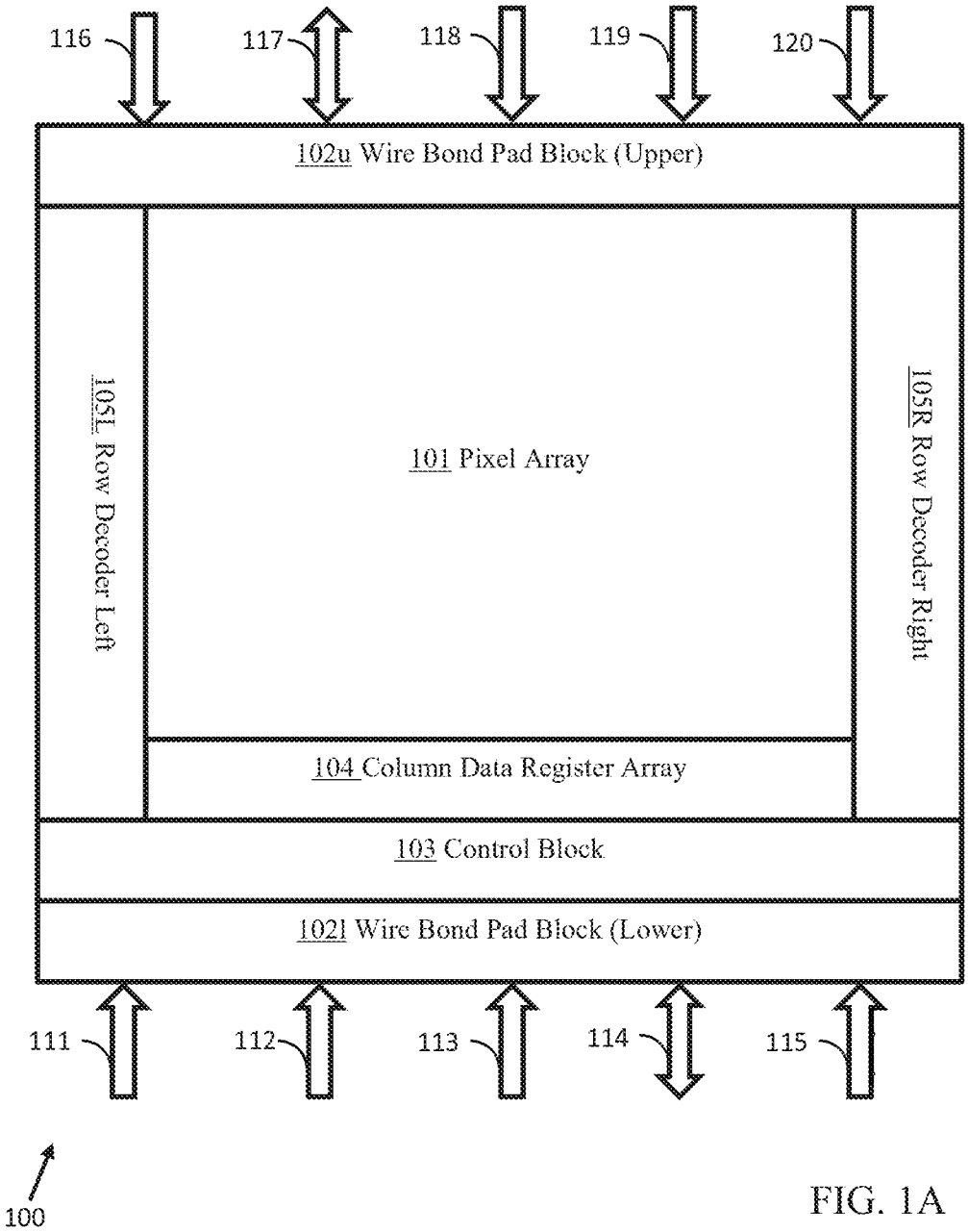
FIG. 1A is a diagram of the layout of a backplane for an array of emissive pixel elements

The present application discloses a backplane comprising an array of emissive element drivers operative to drive emissive devices affixed to the backplane. In one embodiment, a plurality of emissive element drivers is mated to a single mounting pad resulting in a summing of their currents when asserted onto an emissive element affixed to the single mounting pad. In another embodiment, the backplane comprising an array of emissive element drivers further comprises a witness circuit and access point, and a thermalized current management circuit. In one embodiment, a selected plurality of pixel driver elements of the backplane shares a common bias FET element operative to bias the current mirror circuit circuits of a plurality of emissive current drive elements.

In the present application, the preceding general description and the following specific description are exemplary and explanatory only and are not restrictive of the invention as claimed. It should be noted that, as used in the specification and the appended claims, the singular forms "a", "an" and "the" include plural referents unless the context clearly dictates otherwise. Thus, for examples, reference to a material may include mixtures of materials; reference to a display may include multiple display, and the like. Use of the word display is synonymous with the term array of pixels as well as other similar terms. A display need not be used as a means for presenting information for human viewing and may include an array of pixels for any use. All references cited herein are hereby incorporated by reference in their entirety, except to the extent that they conflict with teachings explicitly set forth in this specification. The terms MOSFET transistor, FET transistor, FET and transistor are considered to be equivalent. All transistors described herein are MOSFET transistors unless otherwise indicated. Those of skill in the art will recognize that equivalent circuits may be created in nMOS silicon or pMOS silicon.

The present application deals with binary data used for pulse width modulation. Although common practice is to use the number 1 to indicate an on state and the number 0 to indicate an off state, this convention is arbitrary and may be reversed, as is well known in the art. Similarly, the use of the terms high and low to indicate on or off is arbitrary and, in the area of circuit design, misleading, because p-channel FET transistors are in a conducting state (on) when the gate voltage is low and in a nonconducting state (off) when the gate voltage is high. The use of the word binary means that the data represents one of two states. Commonly the two states are referred to as on or off. It does not mean that the duration in time of binary elements of data is also binary weighted. In emissive displays as those of the present invention, it is often possible for a pixel of the emissive display to achieve an off state that is truly off, in that no noticeable residual leakage of light from that pixel occurs when the data state of the circuit driving a pixel of the emissive device is placed to off.

The term conductor shall mean a conductive material, such as copper, aluminum, or polysilicon, operative to carry a modulated or unmodulated voltage or signal. The word wire shall have the same meaning as the term conductor. The word terminal shall mean a connection point to a circuit element. A terminal may be a conductor or a node or other construct.

The terms light emitting diode or LED is understood to encompass light emitting diodes and may also refer to other types of emissive devices such as organic light emitting diode (OLED), diode lasers and the like. The use of the term LED is not intended to be limiting on the scope of the invention.

These and other objects and advantages of the present invention will no doubt become obvious to those of ordinary skill in the art after having read the following detailed description of the preferred embodiments, which is illustrated in the various drawing figures.

FIG. 1A presents a diagram of the data transfer sections and selected external interfaces of spatial light modulator (SLM) 100. SLM 100 comprises pixel drive circuit array 101, left row decoder 105L, right row decoder 105R, column data register array 104, control block 103, and wire bond pad blocks 102*l* (lower) and 102*u* (upper.) Wire bond pad block 102*l* is configured so as to enable contact with an FPCA or other suitable connecting means so as to receive data and control signals over lines from an SLM controller such as that of FIG. 1C. The data and control signal lines for lower wire bond pad block 102*l* comprise clock signal line 111, op code signal lines 112, serial input-output signal lines 113, bidirectional temperature signal lines 114, and parallel data signal lines 115. The selected interfaces for upper wire bond pad block 102*u* comprise circuit voltages V_H and V_L 116, witness current pad 117, band gap temperature sensor digital interface 118, rail voltages $V_{DDAR}$ and $V_{SS}$, and common cathode return 120.

Wire bond pad block 102 receives image data and control signals and moves these signals to control block 103. Control block 103 receives the image data and routes the image data to column data register array 104. Row address information is routed to row decoder left 105L and to row decoder right 105R. In one embodiment, the value of Op Code line 102 determines whether data received on parallel data signal lines 115 is address information indicating the row to which data is to be loaded or data to be loaded to a row. In one embodiment the row address information acts as header, appearing first in a time ordered sequence, to be followed by data for that row. In the context of the present application, the word "address" is most often a noun used to convey the location of the row to be written. The location may be conveyed as an offset from the location (address) of a baseline row or it may be an absolute location of the row to be written. This is similar to the manner in which a Random-Access Memory device, such as an SRAM, is written or read. The use of column addressing, also used in Random-Access Memory devices, may be envisioned, but other mechanisms, such as a shift register, are also envisioned. Use of a shift register to enable the writing of data to rows of the array is also envisioned.

Row decoder left 105L and row decoder right 105R are configured to pull the word line for the decoded row high so that data for that row may be transferred from column data register array 104 to the storage elements resident in the pixel cells of that row of pixel array 251. In one embodiment, row decoder left 105L pulls the word line high for a left half of the display, and row decoder right 105R pulls the word line high for a right half of the display.

Figure 1B:
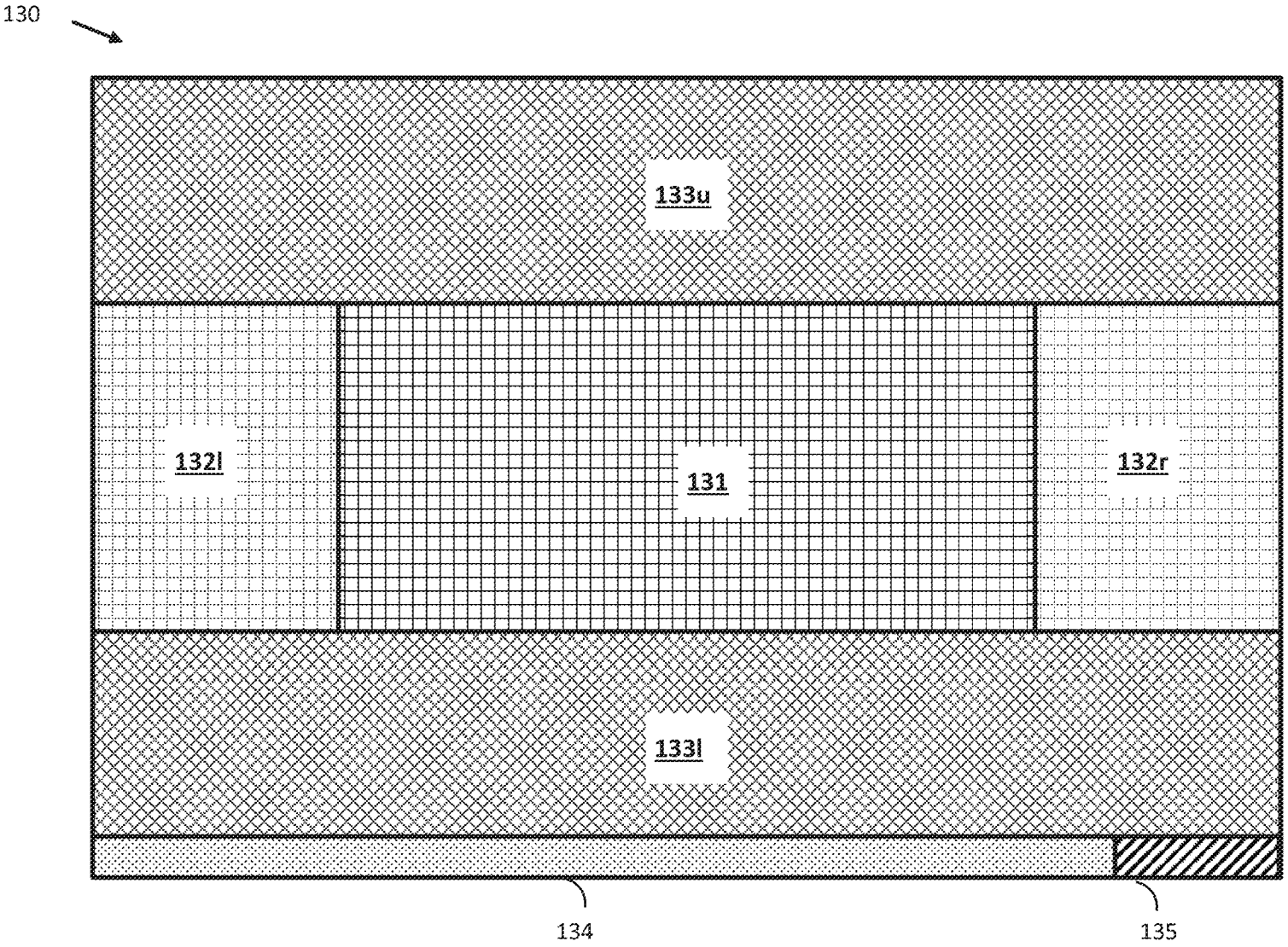
FIG. 1B is a representation of the major elements into which an array of pixel drive circuits is divided.

FIG. 1B presents a diagram of the regions of an array of pixel drive circuits 130, the regions comprising active array 131, inactive pixel drive circuits on active rows 1321 (left) and 132*r* (right), inactive pixel drive circuit rows 133*u* (upper) and 1321 (lower), last row of inactive pixel drive circuits 134, and witness current terminal 135. Active array 131 comprises those pixel drive circuits that will be used as part of the drive of an array of emissive devices. Inactive pixels on active rows 1321 and 132*r* are on the same rows as the pixels of active array 131. In one embodiment, data must be written to all pixel drive circuits of a row whether active or inactive when some of the pixel drive circuits on that row are active pixel drive circuits. In one embodiment, only active pixel drive circuits require that data be written to them. Rows of pixel drive circuits in 133*u* and 1331 do not require that data be written to them. The inactive pixel drive circuits of 134 do not require that data be written to them. In one embodiment, witness current terminal comprises two 4×4 blocks of pixel drive circuits, of which a portion of the output circuits are shorted together to supply a witness current for thermal management circuitry. The portion of the outputs that are shorted together may be hardwired to a data on position. In one embodiment, a witness current block is provided for each different type of emissive circuit present on the backplane, such as for a device that emits a variety of different wavelengths including multicolor display devices or headlamps.

Figure 1C:
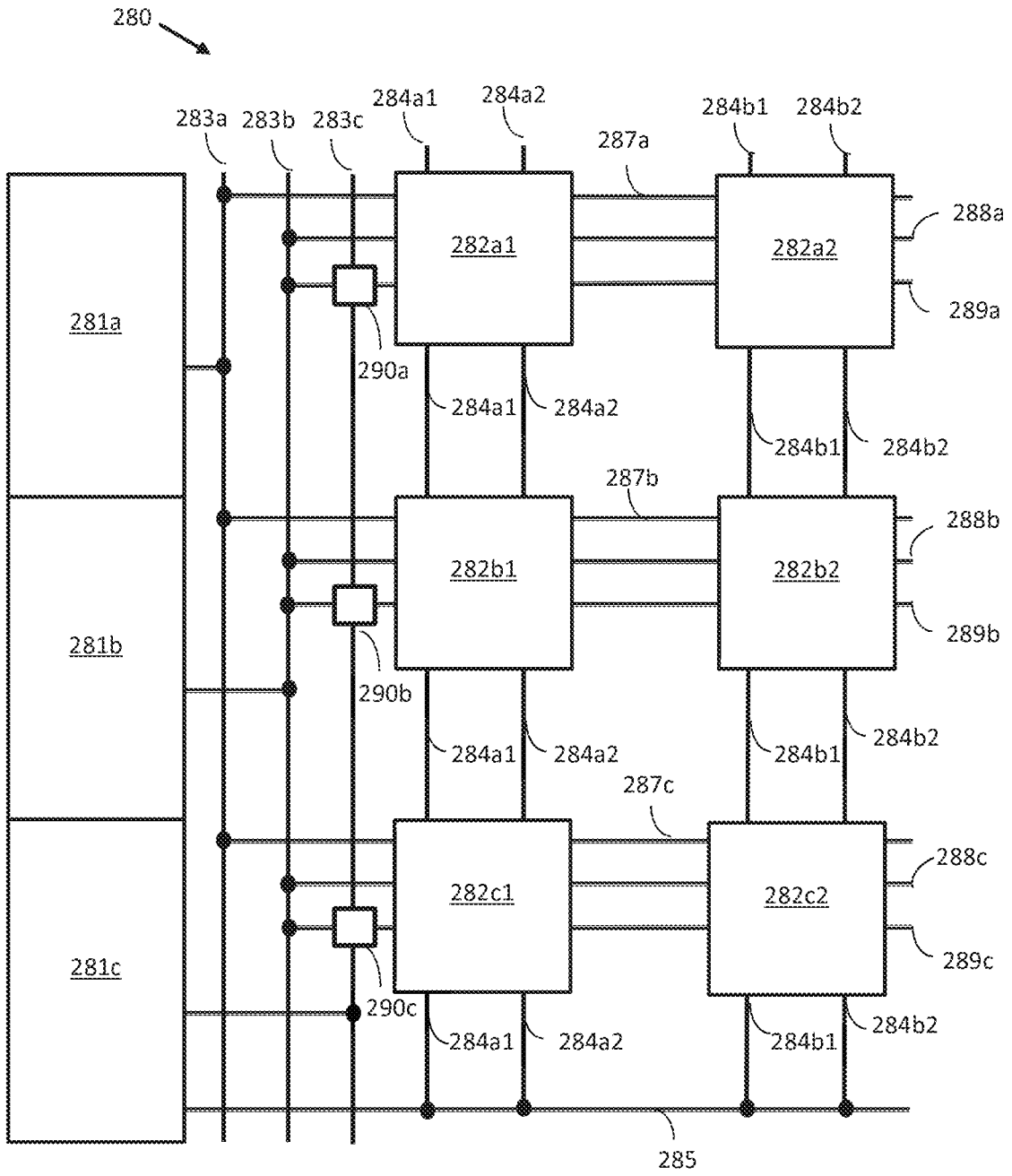
FIG. 1C depicts a backplane and backplane controller interface arrangement.

FIG. 1C depicts a simplified diagram 280 of display controller interfaces with an array of pixel circuits. A display controller comprises static voltage section 281*a*, signal voltage control section 281*b* and data memory and logic control section 281*c*. A first row of pixel circuits comprises pixel 282*a*1 and pixel circuit 282*a*2. A second row of pixel circuits comprises pixel circuit 282*b*1 and pixel circuit 282*b*2. A third row of pixel circuits comprises pixel circuit 282*c*1 and pixel circuit 282*c*2. A first column of pixel circuits comprises pixel circuit 282*a*1, pixel circuit 282*b*1 and pixel circuit 282*c*1. A second column of pixel circuits comprises pixel circuit 282*a*2, pixel circuit 282*b*2 and pixel circuit 282*c*2. The choice of this number of pixel circuits in FIG. 1C is for ease of reference and is not limiting upon this disclosure. Arrays of pixel circuits comprising in excess of 1000 rows and 1000 columns are commonplace in display products.

Static voltage section 281*a* provides a set of voltages required to operate the array of pixel circuits, said voltages comprising $V_{DDAR}$, $V_{SS}$, upper drive voltage V_H and cathode return voltage V_L loaded onto static voltage distribution bus 283*a*. Static voltage distribution bus 283*a* distributes $V_{DDAR}$, V_H, $V_{SS}$ and V_L to the pixel circuits of a first row over conductor 287*a*, to the pixel circuits of a second row over conductor 287*b* and to the pixel circuits of a third row over conductor 287*c*, wherein each of conductors 287*a*, 287*b* and 287*c* comprises a separate conductor for each supplied static voltage.

Signal voltage control section 281*b* delivers control signals required to operate the array of pixels, such as 1_off and word line (WLINE) high for the selected row, over bus 283*b*. Signal voltage control 281*b* delivers signals to signal voltage distribution bus 283*b*, which in turn delivers the signals to the pixels of a first row over conductor 288*a*, to the pixels of a second row over conductor 288*b* and to the pixels of a third row over conductor 288*c*. Conductors 288*a*, 288*b* and 288*c* each may comprise a plurality of conductors such that each control signal is delivered independently of other control signals. The row on which WLINE is to be held high is selected by a row decoder circuit (not shown) Timing of the signal voltages and their application to the circuit are typically controlled by an executive function such as data memory and logic control section 281*c*. The word line for the selected row is one of conductor 289*a*, conductor 289*b* or conductor 289*c*, as determined by the state of each row decoder set by data memory and logic control section 281*c*. L_off is used to control the state of FET 338 of FIG. 2C. When l_off is low, FET 338 asserts V_H onto the gate of large 1 FET 326, effectively shutting it off. When operated with a duty cycle drive waveform, l_off can be used to control the effective intensity of an LED or other emissive device. In one embodiment, l_off is a global signal. In one application, l_off is a local signal configured to control a subset of the global array. The timing of l_off is controlled by data memory and logic control section 281*c*.

Data memory and logic control section 281*c* performs several functions. It may, for example, process data received in a standard 8-bit or 12-bit format into a form usable to pulse-width modulate a display. A first function is to select a row for data to be written to and a second function is to load the data to be written to that row. Data memory and logic control section 281*c* loads image data onto the column drivers (not shown) for each column over bus 285. Conductors 284*a*1 and 284*a*2 represent a first pair of complementary bit lines. Conductors 284*b*1 and 284*b*2 each represent a second pair of complementary bit lines. Each of said pair of complementary bit lines are operative to transfer data from the column drivers (not shown) to the memory cell of each pixel of the selected row. Data memory and logic control section 281*c* loads the selected address information onto address data bus 283*c*, which acts to select the correct row using row decoder circuit 290*a*, row decoder circuit 290*b* and row decoder circuit 290*c* each positioned on address data bus 283*c*. When WLINE for the selected row is held high, the data on the column drivers are loaded into the memory cell of each pixel of the selected row.

The backplane of the present application facilitates operation of an emissive display in several different modes. The backplane uses means for delivering binary modulation data to the memory cell of a pixel of an emissive display using techniques resembling that used by an SRAM. Applicant calls attention to the data sheet for Intel SRAM 2114A, wherein both row and column addressing are enabled. The circuit implementation for addressing data to the memory cell of the pixels of the backplane resembles that described in U.S. patent application Ser. No. 10/329,645, now U.S. Pat. No. 7,468,717, "Method and Device for Driving Liquid Crystal on Silicon Display Systems", Hudson, and in U.S. patent application Ser. No. 10/413,649, now U.S. Pat. No. 7,443,374, "Pixel Cell Design with Enhanced Voltage Control", Hudson, both of which are assigned to the owner of the present application. In one embodiment of the present application, Applicant discloses a backplane wherein data is sent to pixels of a row selected by row addressing means. In one embodiment, the means for addressing pixels of a row with data is based on the random-access row addressing means common to both DRAM and SRAM memory devices. In this embodiment, each row of pixels possesses a unique address configuration wherein the backplane comprises means for decoding the unique address of a row and means for delivering data for that row to the memory devices forming a part of each pixel circuit of that row. In one embodiment said rows are not addressed in sequential order. In one embodiment, Applicant discloses a backplane wherein data is sent to a set of pixels of a row selected by addressing means. The contents of both patents and of the data sheeting for Intel SRAM 2114A are incorporated herein by reference.

Applicant owns patents for several different modulation methods applicable to digital display systems, such as the present invention. These comprise application Ser. No. 13/790,120, now U.S. Pat. No. 9,583,031, U.S. patent application Ser. No. 10/435,427, now U.S. Pat. No. 8,421,828 and U.S. patent application Ser. No. 15/408,869, now U.S. Pat. No. 9,406,269, Lo, et al, "System and Method for Pulse Width Modulating a Scrolling Color Display", U.S. patent application Ser. No. 14/200,116, now U.S. Pat. No. 9,406,269, Lo, et al, "Gray Scale Drive Sequences for Pulse Width Modulated Displays," U.S. patent application Ser. No. 11/740,238, now U.S. Pat. No. 8,111,271 and U.S. patent application Ser. No. 13/340,100, now U.S. Pat. No. 8,264,507, Hudson et al, "Multi-Mode Pulse Width Modulated Displays, U.S. patent application Ser. No. 11/740,238, now U.S. Pat. No. 7,852,307, Hudson, and U.S. patent application Ser. No. 14/712,061, now U.S. Pat. No. 9,918,053, "System and Method for Pulse-Width Modulating a Phase- Only Spatial Light Modulator", Lo, et al. Each of these comprises modulation of a row-addressable spatial light modulator wherein all pixels of an addressed row are written with data.

Figure 2A:
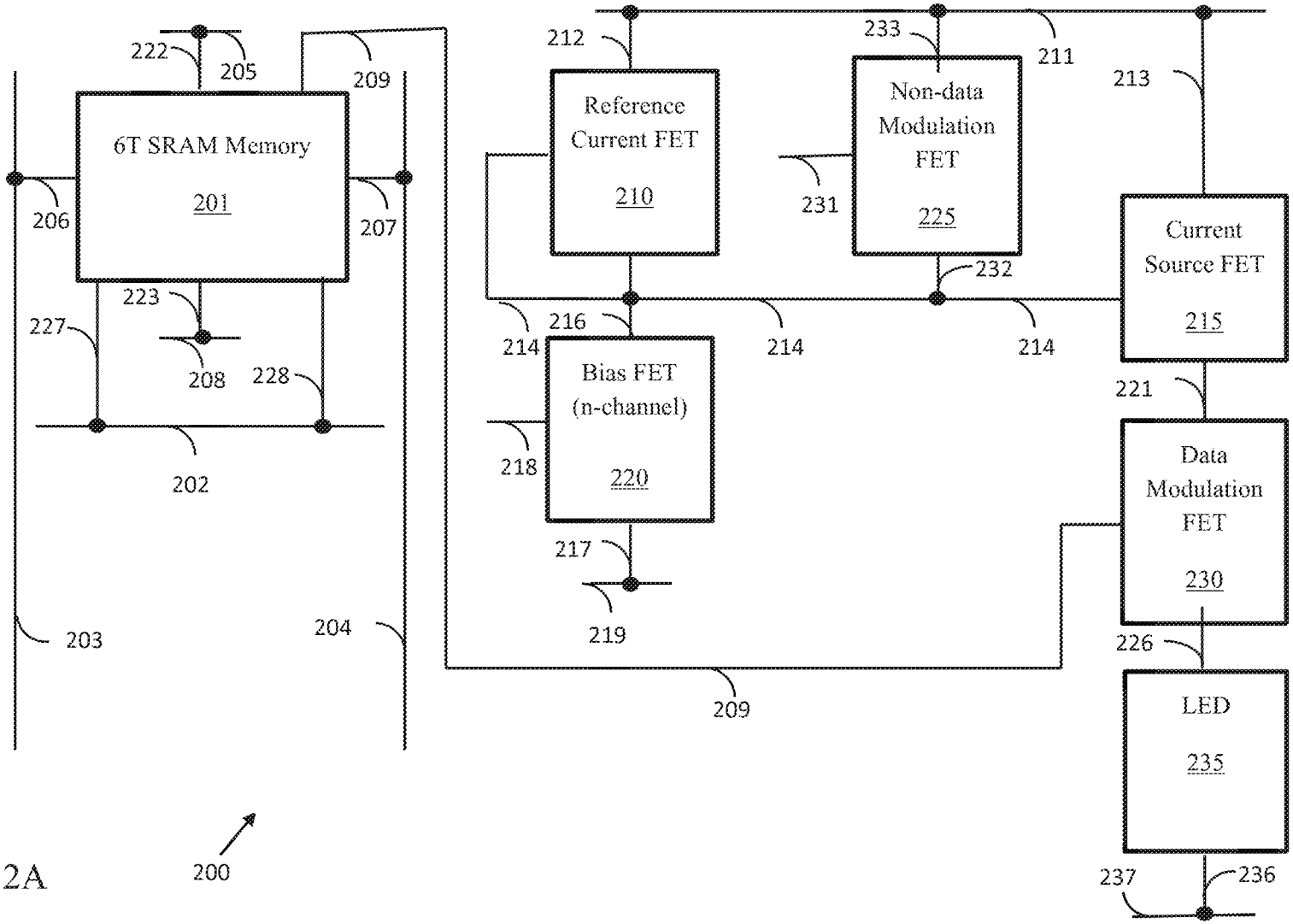
FIG. 2A is a block diagram of a pixel drive circuit forming part of a current mirror backplane for an array of emissive pixel elements.

FIG. 2A presents block diagram 200 of a current mirror pixel circuit of an array of pixels after the present application. Pixel circuit 200 comprises SRAM memory cell 201, a current mirror circuit comprising FETs 210, 215, and 220, non-data modulation FET 225 operative to shut current source FET 215 off when pulled high to an on state and a data modulation section comprising modulation FET 230 operative to pulse-width modulate the output of the drain of modulation FET 230 in order to impose gray scale on LED 235 associated with that pixel. SRAM memory cell is depicted as a 6-T (6 transistor) cell although the use of other SRAM memory cells with different numbers of transistors is anticipated.

SRAM memory cell 201 is connected to word line (WLINE) 202 by conductors 227 and 228. Complementary data lines ($B_{POS}$) 203 and ($B_{NEG}$) 202 connect to SRAM memory cell 201 by conductors 206 and 207 respectively. When WLINE 202 is pulled high, pass transistors in the memory cell allow new data to be stored in the memory cell. Data output $S_{NEG}$ of SRAM 201 is asserted over conductor 209 onto the gate of PWM FET transistor 230. Operation of the 6T SRAM memory is explained in detail in FIG. 2B and its associated text.

FETs 210, 215, 220, 225, and 230 form a circuit operative to deliver a pulse-width modulated drive waveform to LED 235 driven by the pulse width modulated waveform at required voltage and current levels. FET transistors 210 and 220 form a reference current circuit operative to provide a reference current to the gate of current source FET 215 at a required voltage. Reference current transistor 210 sets the reference current $I_{REF}$ and bias FET 220 $V_{REF}$ sets the voltage for the reference current on conductors 214 and 216. Bias FET 220 is a large L n-channel FET designed to operate as a variable resister based on a bias voltage $V_{BIAS}$ applied to its gate over conductor 218. In one embodiment, $V_{BIAS}$ is set externally and, in one embodiment, $V_{BIAS}$ is supplied to all pixel circuits. In one embodiment the gate of bias FET 220 is connected to $V_{SS}$. The source of bias FET 220 is connected to conductor 219 by conductor 217. Conductor 219 is connected to voltage $V_{SS}$. In one embodiment, the stable reference current asserted onto conductor 214 is supplied to a plurality of pixel drive circuits. In one embodiment, the stable reference current is asserted onto the gate of its own current source FET 215 and onto the gates of pixels forming a block of pixels.

Current source FET 215 is operative to receive a stable reference current at its gate over conductor 240 and mirror that current. The source of current source FET 215 is connected over conductor 213 to conductor 211, which supplies voltage V_H. The drain of current source FET 215 asserts a stable current over conductor 221, wherein the stable current may differ from the reference current. To achieve the desired current at the drain of current source FET 215, FET 215 must be designed to deliver that. FET 215 is preferably a large L FET, wherein the relationship between the length (L) and the width (W) is selected in order to achieve the desired current at its drain. The desired current asserted on the drain of FET 215 may differ from the reference current received on the gate of FET 215, depending on the design W/L ratio of current source FET 215. Different W/L designs may be required for pixels of different colors.

FET 225 acts as a non-data driven modulation element on the output of current source FET 215. The gate of modulation FET 225 receives a signal l_off from an external modulation element. The source of FET 225 is connected to conductor 211 by conductor 233, which asserts V_H onto the source of FET 225. If l_off is low then FET asserts V_H minus a small threshold voltage onto its drain, whereupon the substantially V_H voltage acts upon the gate of current source FET 215 to take FET 215 out of saturation mode. This results in FET 215 no longer acting as a current source. This enable signal l_off to act as a form of non-data modulation control signal. The action of l_off is to raise or lower the overall duty cycle of the modulation output of pixel circuit 100, thereby controlling its intensity without regard for the data state of the SRAM cell.

FET 230 comprises a data modulation section suitable to respond to pulse-width modulation waveforms used to create gray scale modulation. The need to perform this function is well known in the art. The output of the drain of FET 215 is asserted onto the source of transistor 230 over conductor 221. The gate of PWM modulation FET 230 is connected to output $S_{NEG}$ of SRAM 201 over conductor 209. When the data state of SRAM 201 is on, then $S_{NEG}$ is low and acts on the gate of PWM modulation FET 230 to enable it to assert the current asserted onto its source over conductor 221 onto its drain over conductor 226.

The output of the drain of PWM modulation FET 230 is asserted onto conductor 226. The output comprises a pulse width modulated signal operative to create a gray scale modulation at a desired intensity. The output is connected over conductor 226 to the anode of an emissive device such as LED 235. The cathode of LED 235 is connected by terminal 236 to V_L asserted onto conductor 237. The voltage level of V_L is lower than V_H and may be lower than $V_{SS}$ and may be a negative voltage.

In order to avoid aliasing caused by the operating rate of l_off should create pulse intervals that is shorter than the shortest pulse duration imposed on S_neg by a substantial margin, perhaps a factor of 10 to 1 in order to avoid aliasing. In some non-display applications, the issue of aliasing may be less important. In that case the pulse interval of l_off may correspond to tens or more of lsb internals. In one embodiment operation of l_off is synchronized with operation of S_neg.

Figure 2B:
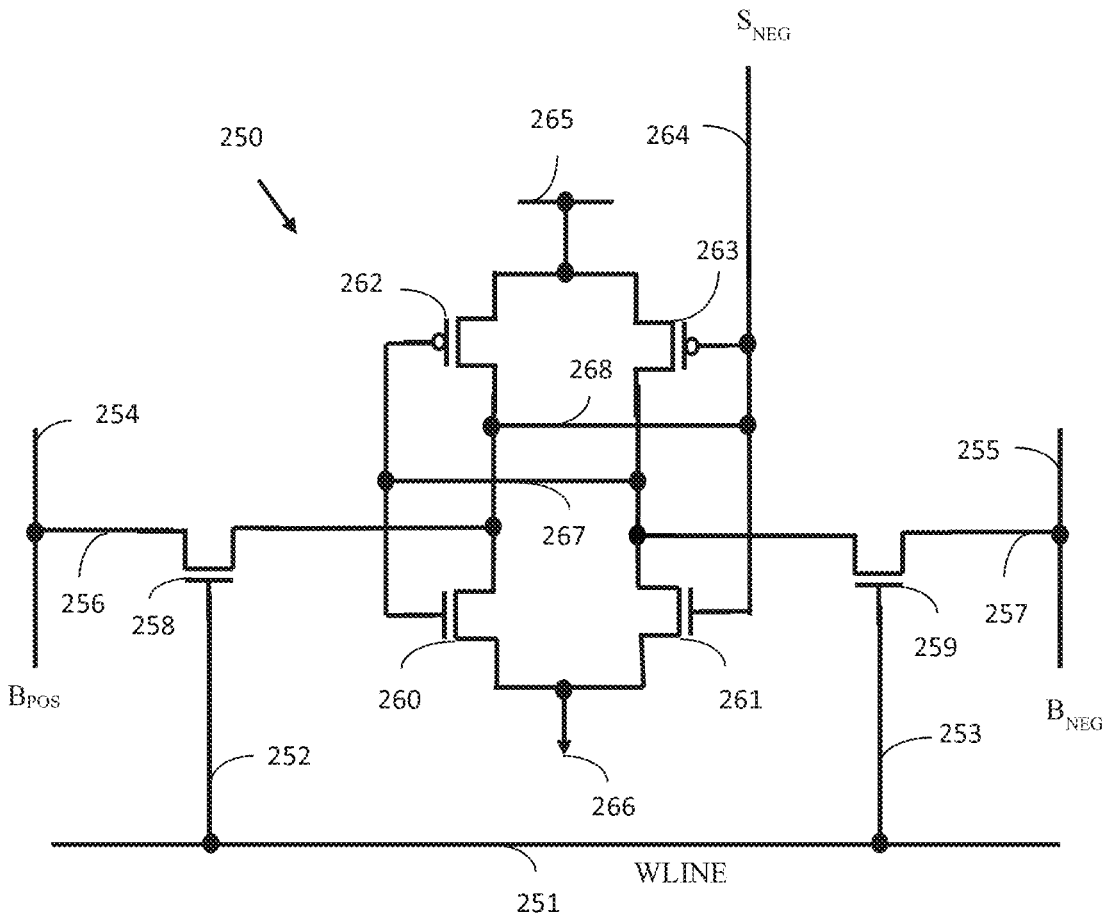
FIG. 2B is a schematic diagram of a 6-transistor static RAM memory for the present invention.

FIG. 2B shows a preferred embodiment of a storage element 250. Storage element 250 is preferably a CMOS static ram (SRAM) latch device. Such devices are well known in the art. See DeWitt U. Ong, Modern MOS Technology, Processes, Devices, & Design, 1984, Chapter 95, the details of which are hereby fully incorporated by reference into the present application. A static RAM is one in which the data is retained as long as power is applied, though no clocks are running FIG. 1B shows the most common implementation of an SRAM cell in which six transistors are used. FETs 258, 259, 260, and 261 are n-channel transistors, while FETs 262, and 263 are p-channel transistors. In this particular design, word line WLINE 251, when held high, turns on pass transistors 258 and 259 by asserting the state of WLINE 251 onto the gate of pass transistor 258 over conductor 252 and onto the gate of pass transistor 259 over conductor 253, allowing ($B_{POS}$) 254, and ($B_{NEG}$) 255 lines to remain at a pre-charged high state or be discharged to a low state by the flip flop (i.e., transistors 262, 263, 260, and 261). The potential on $B_{POS}$ 254 is asserted onto the source of pass transistor 258 over conductor 256, and the potential on $B_{NEG}$ 255 is asserted onto the source of pass transistor 259 over conductor 257. The drain of pass transistor 258 is asserted onto the drains of transistors 260 and 262 and onto the gates of transistors 261 and 263 over conductor 268 while the drain of pass transistor 259 is asserted onto the drains of transistors 261 and 263 and onto the gates of transistors 260 and 262 over conductor 267. Differential sensing of the state of the flip-flop is then possible. In writing data into the selected cell, ($B_{POS}$) 254 and ($B_{NEG}$) 255 are forced high or low by additional write circuitry on the periphery of the array of pixel circuits. The side that goes to a low value is the one most effective in causing the flip-flop to change state. In the present application, one output port 264 is required to relay to circuitry in the remainder of the pixel circuit whether the data state of the SRAM is in an "on" state or an "off" state. The signal output in this case is $S_{NEG}$, asserted onto conductor 264, meaning that when the data state of storage element 250 is high or on, the output of storage element 250 is low. As will be shown regarding FIG. 2C, $S_{NEG}$ is asserted onto the gate of a p-channel FET, causing it to conduct.

SRAM circuit 250 is connected to $V_{DDAR}$ by conductor 265 and to $V_{SS}$ by conductor 266. $V_{DDAR}$ denotes the $V_{DD}$ for the array. It is common practice to use lower voltage transistors for periphery circuits such as the I/O circuits and control logic of a backplane for a variety of reasons, including the reduction of EMI and the reduced circuit size that this makes possible.

The six-transistor SRAM cell is desired in CMOS type design and manufacturing since it involves the least amount of detailed circuit design and process knowledge and is the safest with respect to noise and other effects that may be hard to estimate before silicon is available. In addition, current processes are dense enough to allow large static RAM arrays. These types of storage elements are therefore desirable in the design and manufacture of liquid crystal on silicon display devices as described herein. However, other types of static RAM cells are contemplated by the present invention, such as a four transistor RAM cell using a NOR gate, as well as using dynamic RAM cells rather than static RAM cells.

The convention in looking at the outputs of an SRAM is to term the outputs as complementary signals $S_{POS}$ and $S_{NEG}$. The output of memory cell 250 connects the gate of transistors 263 and 261 over conductor 264 to circuitry (not shown) operative to receive the output of memory cell 250. By convention this side of the SRAM is normally referred as S_neg or $S_{NEG}$. The gates of transistors 262 and 260 are normally referred to as $S_{POS}$. Either side can be used provided circuitry, such as an inverter, is added where necessary to insure the proper function of the transistor receiving the output data state of the memory cell.

Figure 2C:
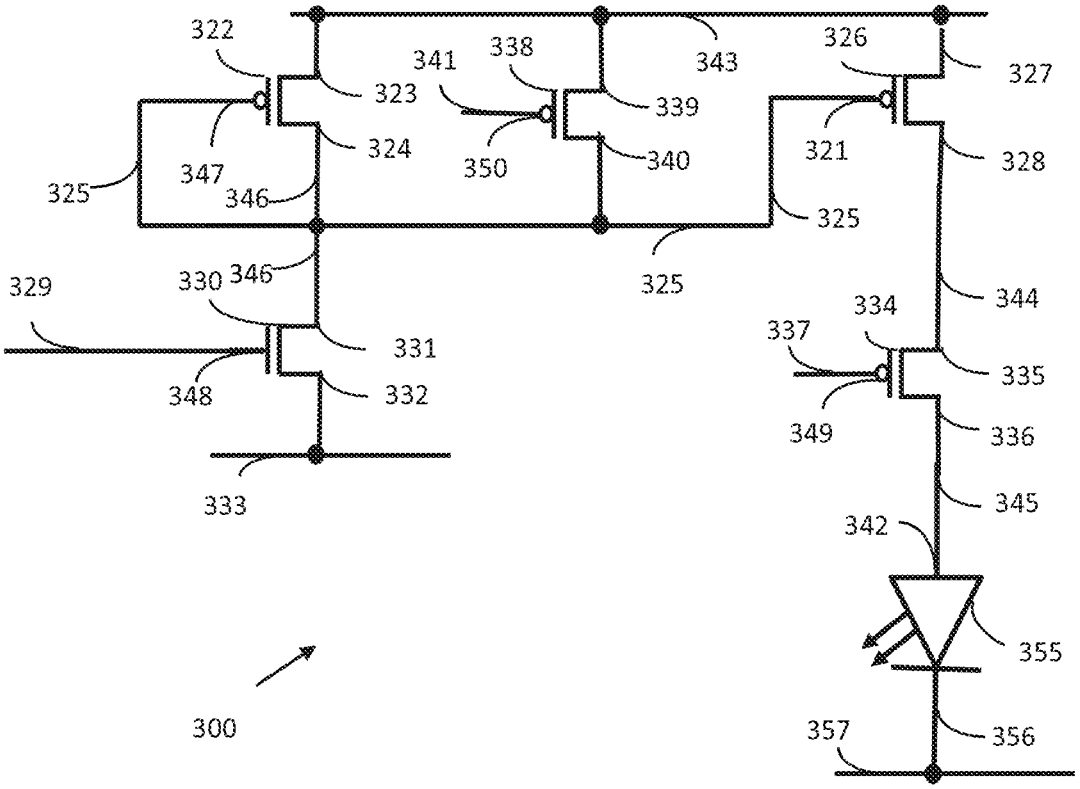
FIG. 2C is a schematic diagram of a current mirror drive circuit for an embodiment of the present invention.

FIG. 2C presents a schematic drawing of a current mirror circuit implementation 300 as presented in the block diagram of FIG. 2A. P-channel reference current FET 322 and p-channel current source FET 326 together form part of a current mirror unit suitable to provide an unmodulated current to a modulating circuit at a voltage set by the voltage applied to the gate of large L n-channel bias FET 330.

Source 323 of reference current FET 322 is connected to voltage V_H asserted on conductor 343, wherein V_H is an external global voltage that is separate from other external global voltages such as $V_{DDAR}$ and $V_{SS}$. Reference current FET 322 is operated in diode mode wherein gate 347 and drain 324 are connected by electrical conductor 325 and conductor 346. Gate 347 and drain 324 of reference current FET 322 are connected to gate 321 of current source FET 326 as described herein. Conductor 325 and conductor 346 are electrically connected to gate 321 of current source FET 326 over conductor 352. Reference current FET 322 sets the reference current for the current mirror circuit. In one embodiment, V_H is equal to $V_{DDAR}$.

N-channel bias FET 330 is a large L FET transistor that acts as a variable resistor when operated in saturation. Drain 331 of bias FET 330 is connected to gate 347 and drain 324 of reference current FET 322, all of which are connected to gate 321 of current source FET 326 as described previously. Source 332 of large L n-channel bias FET 330 is connected to $V_{SS}$ over conductor 333. Gate 348 of bias FET 330 is connected to bias voltage $V_{BIAS}$ over conductor 329. Pixels with different color LEDs may have different $V_{BIAS}$ requirements so a plurality of different $V_{BIAS}$ voltages applied over independent circuits is conceived for pixels of different colors.

Together reference current FET 322 and bias FET 330 deliver a stable reference current at a fixed voltage to gate 321 of transistor 326. The fixed voltage is determined by voltage $V_{BIAS}$ asserted on gate 348 of bias FET 330.

Source 327 of current source 326 is connected to conductor 343 which supplies voltage V_H. This places source 323 of reference current FET 322 and source 327 of current source FET 326 at the same potential and electrically connected through conductor 343. Drain 328 of current source FET 326 delivers a required voltage and current. The voltage and current output of drain 328 is delivered to source 335 of data modulation FET 334 over conductor 344.

As is well known in the art, current source FET 326 may be designed to deliver a stable current over drain 328 that is greater or lower than the reference current delivered to gate 321 of current source FET 326. Because reference current FET 322 and bias FET 330 are unaffected by the data state of the associated memory device (not shown), in one embodiment the output of the reference current FET of one pixel may act as reference current FET for a nearby pixel provided the voltage of the reference current is also compatible with the LED on the nearby pixel. Because of the aforementioned statement regarding current source FET 326, it is clear that different currents may be derived from a single reference current. The nearby pixel sharing a reference current FET may therefore receive a different current and have an associated LED of a different color type provided a compatible voltage is delivered. A mechanism for creating different current outputs is a change to the W/L aspect ratio of current source FET 326.

P-channel non-data driven modulation FET 338 is placed adjacent and electrically parallel to large L current source FET 326. When gate 350 of non-data modulation FET 338 is held low source 339 is connected to drain 340, effectively connecting V_H from conductor 343 onto conductor 352 minus a small threshold voltage. This places gate 321 of current source FET 326 at a voltage near voltage V_H on source 327, which takes current source FET 326 out of saturation and effectively shuts it off as a current source. This provides a modulation capability independent of the data state of the memory cell.

Non-data driven modulation FET 338 may be turned "on" or "off" by a number of different modulation requirements. In one embodiment, a relatively high frequency rectangular waveform of varying duty cycle may be used to lower the apparent intensity of an LED. In another embodiment, a waveform is imposed on modulation FET 338 that serves to cause on state LEDs to emit light for a time equivalent to a desired modulation duration. Other modulations are envisioned. Light is emitted by LED 355 only when data modulation FET 334 is in an on state and non-data modulation FET 338 is in an off state.

Modulation FET 334 forms a data modulation section. Modulation FET 334 is turned on or off in response to the data state stored in a memory cell such as memory cell 250 of FIG. 2B. Modulation FET 334 turns on when on state data stored in a memory device such as memory cell 250 of FIG. 2B causes a low voltage to be applied to gate 349 of p-channel modulation FET 334, thereby causing modulation FET 334 to assert an output onto drain 336. The output (voltage and current) of modulation 334 is asserted by drain 336 onto conductor 345 that connects to anode 342 of LED 355.

The output (voltage and current) of current source FET 334 onto drain 336 is connected to conductor 345. The output comprises pulse-width modulated current and voltage, suitable to be applied to anode 342 of LED 355. The cathode of LED 355 is connected to voltage supply V_L wherein V_L is lower than V_H and may be lower than $V_{SS}$ or may be a negative voltage. The level of V_L is selected so that the difference between the voltage asserted on the anode of LED 555 and the voltage asserted on the cathode of LED 55 is sufficient to cause LED 555 to discharge when circuit 300 is an on state.

Figure 2D:
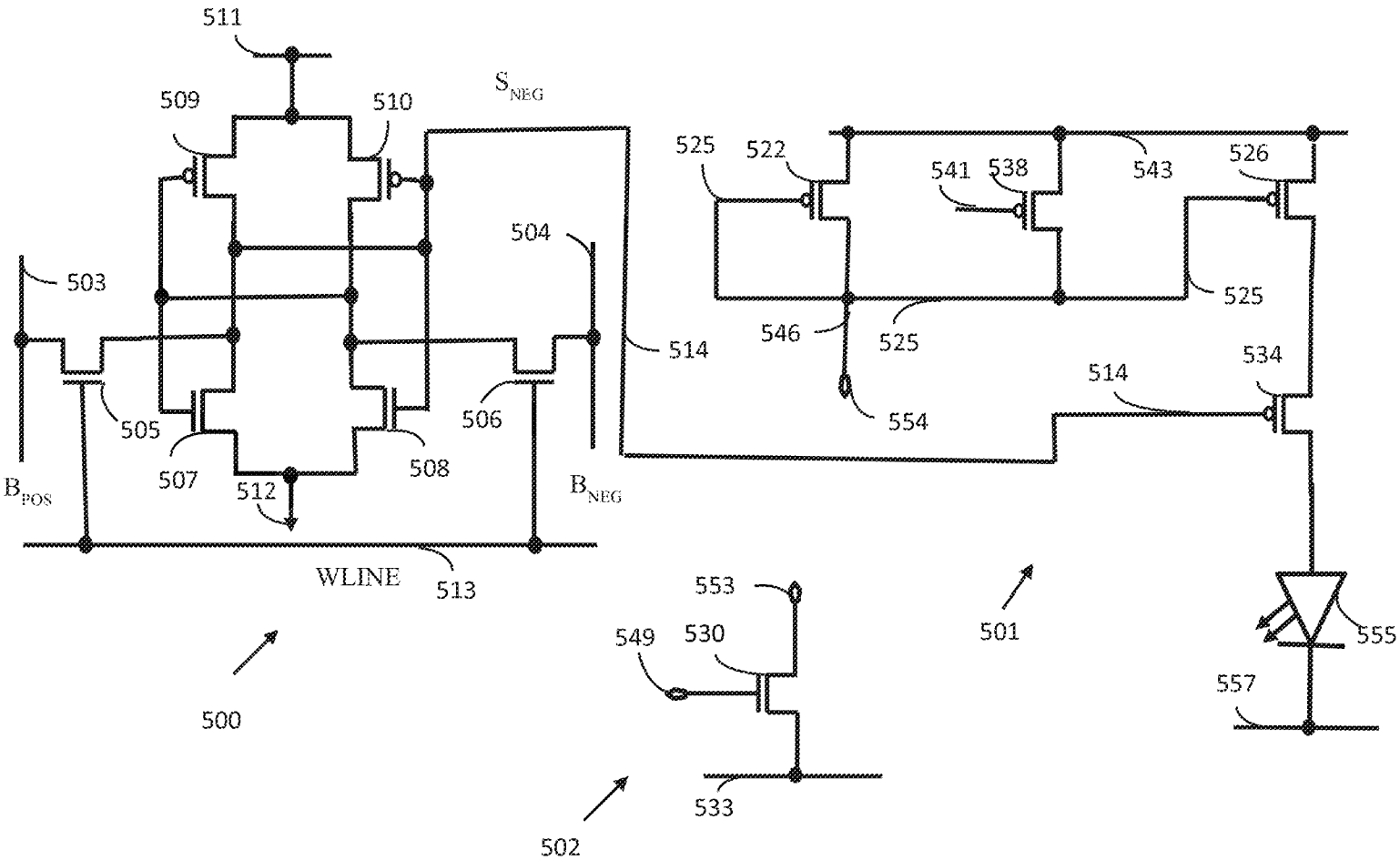
FIG. 2D is a schematic diagram of a memory cell and current and modulation section and a bias voltage circuit.

FIG. 2D presents an emissive pixel circuit similar to the pixel drive circuit presented in FIGS. 2A to 2C. The emissive pixel drive circuit comprises memory cell 500, current and modulation section 501 and large L n-channel bias circuit 502. In the present invention all pixel drive circuits comprise a memory cell 500 and a current and modulation section 501. Some pixel elements share an instantiation of large L n-channel bias circuit 502 with at least one other pixel element, wherein the at least one other pixel circuit comprises a memory cell 500 and a current and modulation section 501 and wherein the at least one other pixel circuit is contiguous to the pixel circuit containing the shared large L n-channel bias FET. Some pixel circuits comprise only a memory cell 500 and a current and modulation section 501, with no large L n-channel bias FET shared with an adjacent pixel circuit. The distribution of the shared large L n-channel FETs is an important aspect of the present invention. In one embodiment, all pixel drive circuits of a block of pixels share a single large L n-channel FET 502. In one embodiment, additional large L n-channel FETs are available within the circuits of nearby pixels but are not electrically connected.

Memory cell 500 is a 6-transistor static random-access memory (SRAM) substantially identical to the memory cell of FIG. 2B. Memory cell 500 comprises pass transistors 505 and 506 operative to simultaneously turn on when the voltage on word line 513 is pulled high by a row select circuit (not shown.) P-channel FET 509 and n-channel FET 507 form a first inverter and p-channel FET 510 and n-channel FET 508 form a second inverter. Complementary image data is loaded onto bit line 503 ($B_{POS}$) and onto bit line 504 ($B_{NEG}$). When pass transistor 505 is turned on by a voltage applied to WLINE 513, the data loaded onto bit line 503 is asserted onto the drain of p-channel FET 509 and the drain of n-channel FET 507 and onto the gates of p-channel FET 510 and n-channel FET 508. Similarly, when pass transistor 506 is turned on by a voltage applied to WLINE 513, the data loaded onto bit line 504 is asserted onto the drain of p-channel FET 510 and the drain of n-channel FET 508 and onto the gates of p-channel FET 509 and n-channel FET 507.

The sources of p-channel FETs are connected to $V_{DDAR}$ ($V_{DD}$ array) over conductor 511 and the sources of n-channel FETs 507 and 509 are connect to $V_{SS}$ (ground) over conductor 512.

Noting that the data on bit line 503 is complementary to the data on bit line 504, the line that hold the 0 data at the lower voltage is more effective at changing the state of the memory cell. The inverse of the resulting state of the memory cell asserted onto data signal conductor 514 ($S_{NEG}$). Specifically, if the data state of memory cell 500 is high, then the output on conductor 514 is low and vice versa.

Current and modulation section 501 comprises p-channel reference current FET 522 and p-channel current source FET 526, forming a reference current/current source pair, p-channel non-data modulation FET 538 operative to impose a non-data driven modulation on current and modulation section 501 and p-channel modulation FET 534 operative to impose a data driven modulation on current and modulation section 501.

Current and modulation section 501 receives the output of memory cell 500 over data signal conductor 514 and uses this to modulate the current generated in circuit 501. P-channel reference current FET 522 and p-channel current source FET 526 form a current mirror circuit. The voltage bias level of current source 522 is set by large L n-channel bias circuit 502 wherein the drain of large L n-channel bias FET is connected over terminal 553 to terminal 554 which connects to the gate and drain of p-channel FET 522 over conductors 546 and 525. The source of large L n-channel FET is connected to $V_{SS}$ over conductor 533. The source of p-channel reference current FET 522 is connected to a global supply voltage V_H asserted on conductor 543. The value of V_H is independent of $V_{DDAR}$ and is selected so that the correct operating voltage is asserted onto emissive device 555 in conjunction with a second global voltage V_L asserted onto conductor 557 as explained below. The source of large L p-channel current source FET 526 is also connected to global voltage V_H asserted on conductor 543.

Large L p-channel current source FET 526 mirrors the reference current generated by p-channel reference current FET 522. As is well known in the art, the current from large L p-channel current source FET 526 may be the same as the current from reference current FET 522 or may greater or less depending on differences in the ratio of width to length between the physical instantiations of reference current FET 522 and current source FET 526. The W/L ratio of current source FET 526 may be scaled up or down relative to the W/L ratio of reference current FET 522 to either scale the current down or up. Those of skill in the art will recognize that for a given conductor material, length and thickness, an increase in width will reduce the resistance.

Modulation FET 538 receives modulation signal l_off over terminal 541 on its gate. L_off is a non-data dependent signal used to impose a duty cycle modulation on an emissive pixel. L_off may be used to cause a dimming of any emissive pixels in an on state. Modulation FET 538 is parallel to large L p-channel current source FET 526. When l_off is held low, modulation FET 538 pulls the voltage asserted on the gate of large L p-channel current source FET 526, thereby effectively shutting off the current mirror function which in turn effectively reduces the current to zero. This in turn shuts off emissive device 555.

The current output on the drain of large L current source FET 526 is asserted on the source of p-channel data modulation FET 534. As a p-channel device, modulation FET 534 will assert the signal on its source onto its drain (minus a threshold voltage) when the signal asserted on its gate is low. The signal asserted on the gate of modulation FET 534 is $S_{NEG}$, which is the complement of the data state of memory element 500, as previously noted. The drain of modulation FET 534 is asserted onto the anode of emissive element 555.

The apparent brightness of emissive element will depend on the magnitude of the current asserted on its anode integrated over time. An increase in off time due to the actions of non-data modulation FET 538 and data modulation FET 534 will reduce the apparent brightness of the emissive element. The cathode of emissive element 555 is connected to a global voltage V_L asserted onto conductor 557, wherein V_L is independent of rail voltages $V_{DDAR}$ and $V_{SS}$. In one embodiment all cathodes are connected to the same global voltage V_L in a common cathode arrangement. In one embodiment, V_L is equal to $V_{SS}$.

Bias circuit 502 comprises large L n-channel bias FET 530 and connection to other circuit elements. The source of large L n-channel bias FET is connected to $V_{SS}$. The gate of bias FET 530 is connected to a bias reference voltage $V_{BIAS}$ supplied from a source external to the pixel. In one embodiment, $V_{BIAS}$ is supplied by a temperature stabilizing device operative to adjust $V_{BIAS}$ in response to changing temperature to ensure that the current from the current mirror does not vary beyond a small amount as a function of temperature.

All active pixel circuits must have a biasing circuit such as bias circuit 502. Not all pixels may be required to be active in a particular instantiation of an array of pixel drive circuits formed from pixel elements such as that of FIG. 2D. In those instances where the underlying pixel circuit element is not to be connected to an emissive device through a metal layer, the source and drain of large L n-channel FET 530 may be connected to ground.

FIG. 3A depicts a layout 360 of a four by four arrangement of pixel drive circuits. Each pixel drive circuit is identified by (column, row) with columns left to right and rows top to bottom. In the design process for an array of pixel drive circuits it is common practice to create a block approach using a number of pixel circuits that can be duplicated across the entire array. This enables the pixel drive circuits to share some critical voltage circuits such as $V_{DDAR}$ and $V_{SS}$, among others in an efficient manner that would not be possible if each pixel were a separate block. The choice of a 4×4 block of pixel circuits is convenient, but could be replaced with other arrangements, such as a 3×3 block, a 5×5 block or a 4×8 block.

Figure 3B:
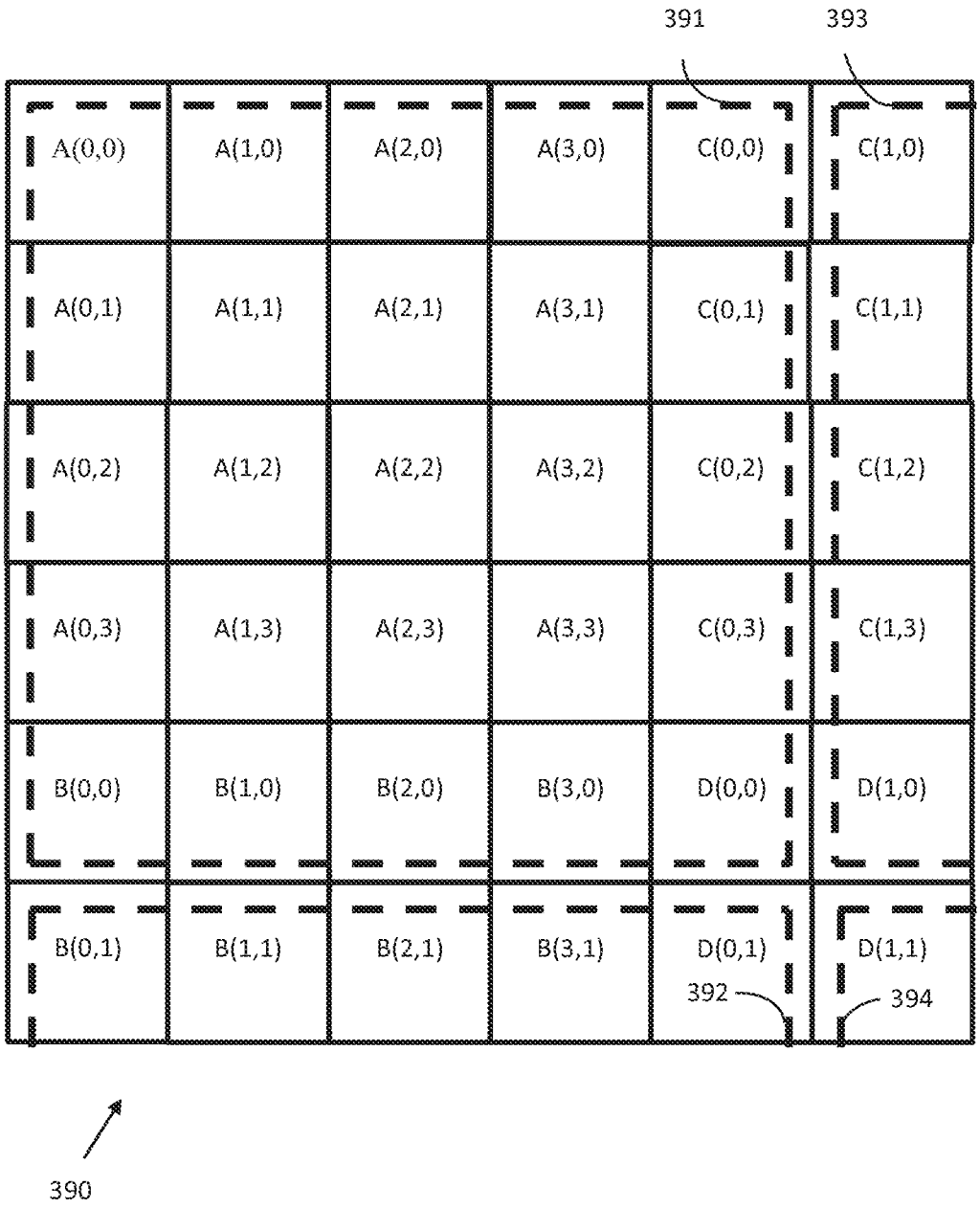
FIG. 3B is a diagram of a 4×4 block of pixel circuits with an overlay of a conductive mounting pad for the anode of an emissive device.

FIG. 3B depicts an array of pixel circuits 390 with an overlay of a full conductive mounting plate 391 for an emissive device such as an LED. Conductive mounting plate 391 covers a 5×5 area of pixel drive circuits. Conductive mounting plates 392, 392 and 394 are depicted in part and, if fully depicted, would each cover a 5×5 section of pixel drive circuits. The pixel drive circuits underlying conductive mounting plate 391 comprise elements of four different 4×4 pixel blocks. The convention for the numerical position within the pixel block is as with FIG. 4A with column and row in that order in parentheses. The letter indicates the block of pixel drive circuits of which the pixel drive circuit is a member. Conductive mounting plate lies over all sixteen pixel drive circuits A(0,0) to A(3,3) of pixel block A, over four pixel drive circuits B(0,0) to B(3,0) of pixel block B, over four pixel drive circuits C(0,0) to C(0,3) and over pixel drive circuit D(9,9) of pixel block D.

The actual number of pixel drive circuits that need to be connected to conductive mounting plate 391 will depend on the peak current required to drive the emissive device at the desired intensity. In its simplest form, the number of connections from the underlying pixel drive circuits can be changed by changing the via mask to include or exclude specific circuit elements. Because the output of the pixel drive circuits is substantially the same and because they are in parallel and not series, the peak current available to drive an emissive device mounted to a conductive mounting plate is the sum of the peak currents of the individual pixel drive circuits. Additionally, a pixel drive circuit that is connected to a conductive mounting plate may be excluded by loading off state data to its memory cell.

This is an instance of the fabric concept of semiconductor design wherein a given design is configured so that it may be tailored to specific applications through a change of the via mask. A greater level of tailoring can be accomplished through changes to the size of the conductive mounting plate to accommodate emissive devices with different optimal spacings between adjacent emissive devices. This requires a change to the top metal layer since the conductive mounting plate is designed into that layer. This will also require a change to the via mask. An additional metal layer may be changed in order to ensure that all pixel driver circuits that need to be active are active and that substantially no pixel driver circuits that do not need to be active are drawing current. There is always the possibility that a few blocks of pixel drive circuits around the edges of the emissive region may have elements in both categories. The array of pixel drive circuits is considered to be a fabric upon which the remaining layers are built.

An action that may be taken to reduce the total current through the array of pixel drive circuits is to ensure that no connection is made between node 553 of large L n-channel bias circuit 502 of FIG. 3B and node 554 of current and modulation section 501 of the same figure. Preferably, node 553 is connected to ground.

Figure 3C:
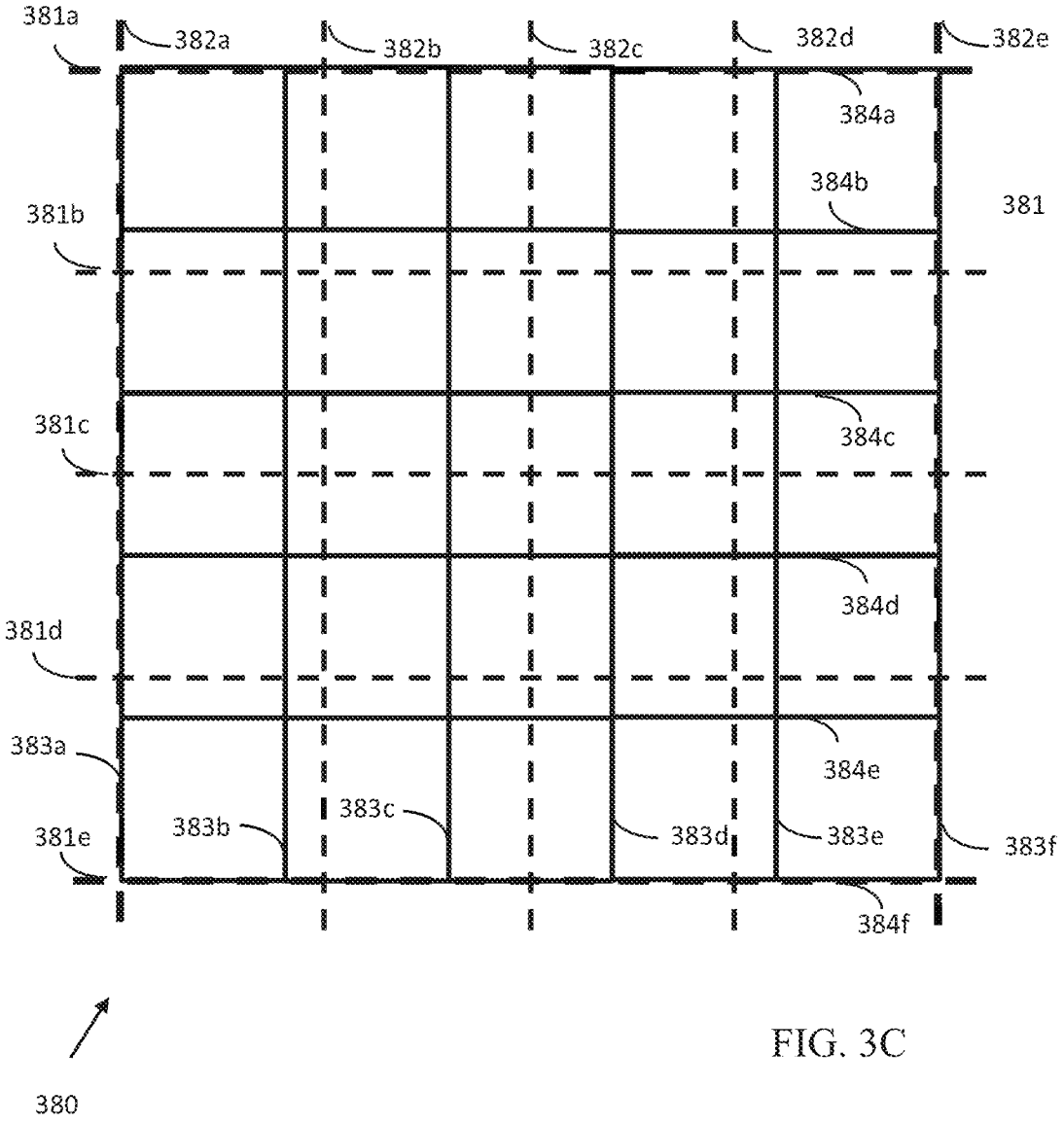
FIG. 3C is a diagram of a section of an array of pixel circuits comprising 4×4 blocks of pixel circuits with an overlay of an array of electrodes, each with dimensions larger the 4×4 block
Figure 4A:
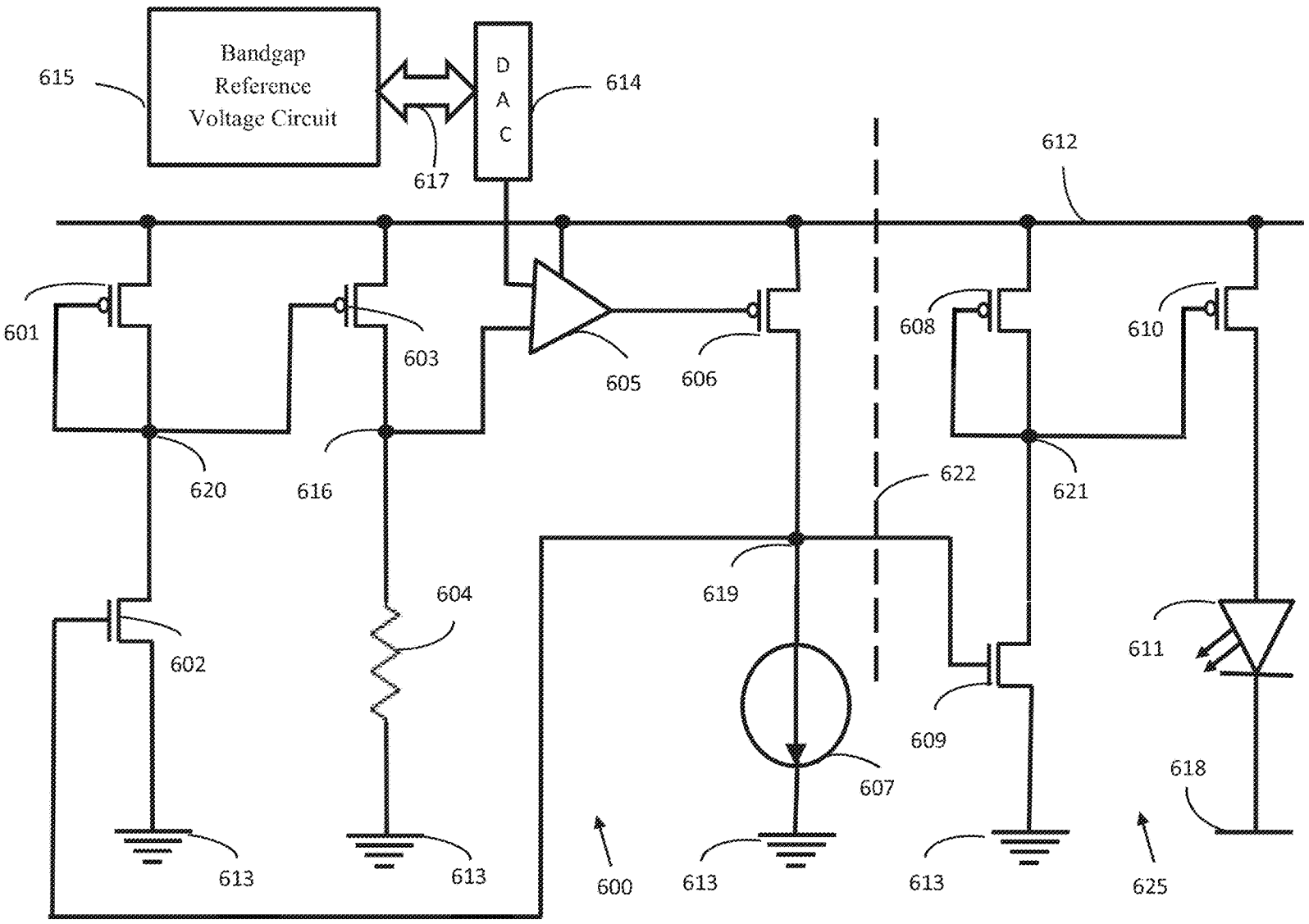
FIG. 4A is a schematic diagram for a current control circuit.
Figure 4B:
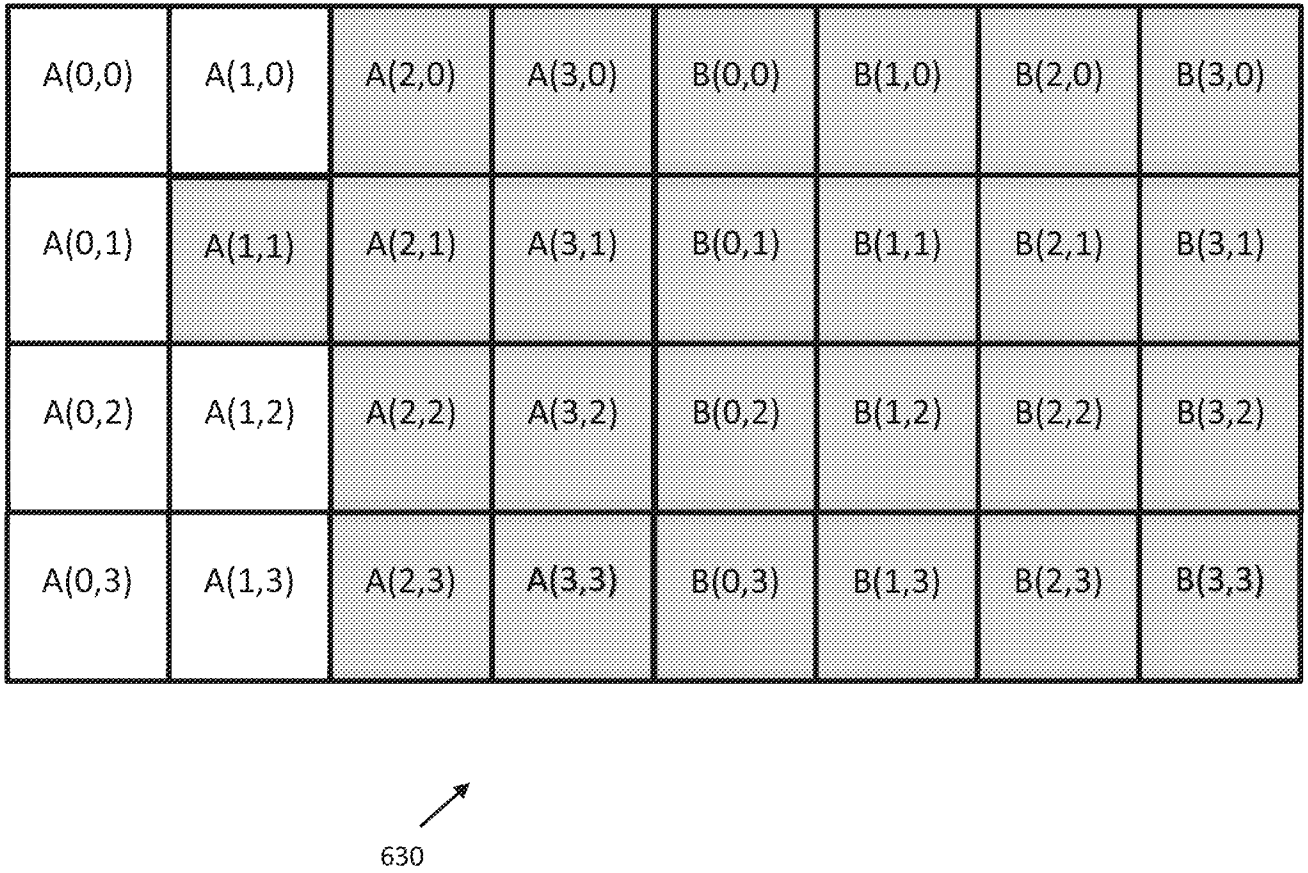
FIG. 4B represents a schematic diagram for a witness current access point.

FIG. 3C presents a plurality of pixel blocks and a plurality of conductive mounting blocks 380, wherein each pixel block comprises a 4×4 array of pixel drive circuits as discussed with respect to FIG. 4B represented with solid lines, overlaid with a set of conductive mounting plates as previously discussed, represented by dashed line. Vertical solid lines 383*a*, 383*b*, 383*c*, 383*d*, 383*e* and 383*f* and horizontal solid lines 384*a*, 384*b*, 384*c*, 384*d*, 384*e* and 384*f* define the outlines of the separate 4×4 pixel blocks. Vertical dashed lines 382*a*, 382*b*, 382*c*, 382*d* and 382*e* and horizontal dashed lines 381*a*, 381*b*, 381*c*, 381*d* and 381*e* define the outlines of the separate 5×5 outlines of conductive mounting plates as previously described.

By inspection, each conductive mounting block lies over a number of underlying blocks of pixel drive circuits. This situation is acceptable provided the outputs of the individual pixel drive circuits adjacent to one another but lying in different pixel blocks and driving the same conductive mounting block are substantially similar. This can be accomplished if the voltages of the individual pixel drive circuits are similar.

Some differences in the performance of nearby instantiations arise due to process variations. One particular variation of interest is the variation of the W/L (width to length) ratio, which is of particular interest for the large L FETs that are used in reference current/current source circuits. The variations in W and L both arise during manufacturing of the semiconductor die due to the lithography process although the specific underlying causes between the two are not necessarily the same. One means of addressing this issue is to avoid the use of minimum feature sizes for those FETs where achieving a desired W/L ratio is of sufficient importance to warrant the extra space a non-minimum feature size FET would require.

Figure 3D:
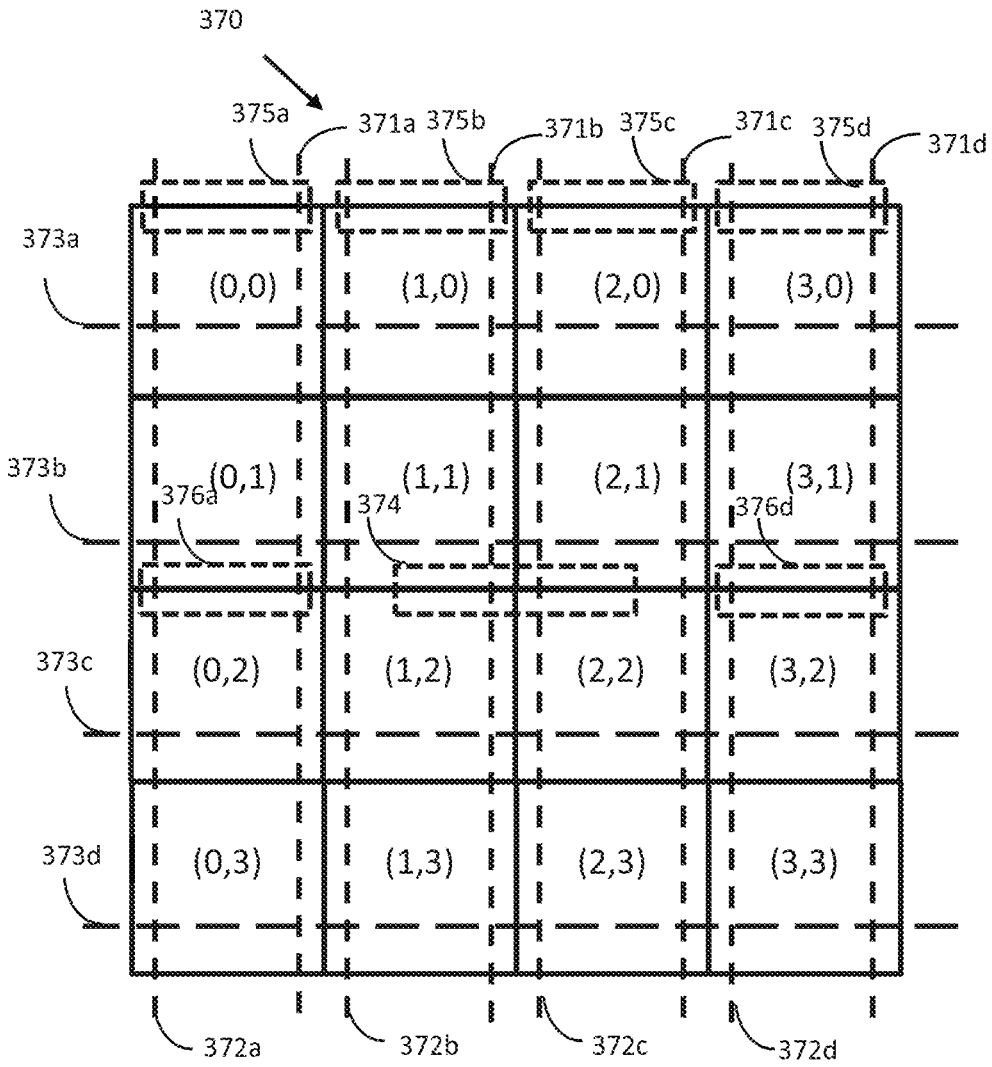
FIG. 3D is a diagram of a 4×4 block of pixel circuits depicting the positioning of a primary bias FET and secondary bias FETs.

FIG. 3D presents an array of pixel drive circuits 370 comprising 16 pixel drive circuits (0,0) through (3,3) following the previously described number convention of (column, row). Complementary bit line pairs 371*a* and 372*a*, 371*b* and 372*b*, 371*c* and 372*c*, and 371*d* and 372*d* provide data corresponding to $B_{POS}$ and $B_{NEG}$ of FIG. 2B. Word lines 373*a*, 373*b*, 373*c* and 373*d* function as described for FIG. 2B. Item 374 denotes a large L n-channel FET (hereafter FET 374) similar to FET 530 of FIG. 3B. In one embodiment, the length of large L n-channel FET 374 is greater that the pitch between adjacent pixel drive circuits. Items 375*a*, 375*b*, 375*c*, 375*d*, 376*a* and 376*d* are back large L n-channel FETs (hereafter FETs 375*a*, 375*b*, 375*c*, 375*d*, 376*a* and 376*d*) also similar to FET 530 of FIG. 3B. In one embodiment the length L of any of FETs 375*a*-376*d* are roughly half of the length of FET 374 while the width W is approximately the same as FET 374. The length of FETs 375*a*-375*d* may vary from approximately half the length L of FET 374. The length L of each of FETs 375*a*-375*d* may vary from one another. In one embodiment, two or more of FETs 375*a*-375*d* may be placed in series with one another. In one embodiment, FET 374 may be disabled and only one or more of FETs 375*a*-375*d* may be used. The choice of length L for FETs 375*a*-375*d* may be chosen for a variety of reasons. For example, a size may be chosen to ensure a desired pixel drive circuit size is met. A size may be chosen because the emissive device it is driving requires a particular current level not within the range available through FET 374.

In one embodiment, pixel drive circuits (0,0) and (0,1) form a dual pixel drive circuit pair sharing FET 375*a*. In like manner, pixel drive circuits (1,0) and (1,1) share FET 375*b*, pixel drive circuits (2,0) and (2,1) share FET 375*c*, pixel drive circuits (3,0) and (3,1) share FET 375*d*, pixel drive circuits (0,2) and (0,3) share FET 376*a* and pixel drive circuits (3,2) and (3,3) share FET 376*d*. In one embodiment, less than all of the dual drive circuit pairs are configured in that manner.

Pixel drive circuits (1,2), (2,2), (1,3) and (2,3) do not share large L n-channel FETs and may be configured to use FET 374 or another FET forming part of a dual pixel drive circuit pair. No physical large L n-channel FET such as FET 530 of FIG. 3B is placed in those pixel drive circuit boundaries.

One issue that affects the performance of a driver circuit for an emissive device is operating temperature. Up to 15% of the output of an emissive device operating over a wide range of temperatures may be lost at the higher temperatures when compared to the lower temperatures. This is due to a reduction in current in the current mirror circuit. This issue has its roots in the change in threshold voltage $V_T$ and in the increase in electron mobility that occurs when a FET changes temperature. Electron mobility increases as temperature increases and $V_T$ in general tends to decrease under the same circumstance. There are exceptions to the latter point, but the first point is nearly universally true.

Temperature differences are only one source for variations in threshold voltage and electron mobility. Process variations can result in changes to threshold voltage and electron mobility between different wafer runs of the same design even though the wafers are fabricated from the same mask sets. A full discussion of process variations is beyond the scope of this specification. In one reference regarding a 0.25 μm process, a process variation that affects the length and width (±10%), threshold voltage (±60 mV), and oxide thickness (±5%) of the parameters of the device. This reference is found in "Digital Integrated Circuits A Design Perspective", $2^{nd}$ Ed., Rabaey et al, pages 120-122, originally published 2003, London.

The effects of process variation can be estimated from corner lots configured according to the limits of the process and by also estimating a typical corner lot. (Although a typical lot is not a corner the use of the term in that manner is commonplace and well understood.) The terminology in use currently to describe a corner lot is to use a two-letter designator where the first letter refers to the state of n-channel FETs and the second letter refers to the state of p-channel FETs. These are used to perform a front end of line or FEOL analysis and they have the greatest impact on the performance of the circuit under analysis although other analyses are possible.

The letters used in the two letter designator are t (typical), f (fast) and s (slow). A tt corner has nominal characteristics for both p-channel and n-channel FETs. An ff corner has fast characteristics for both p-channel and n-channel FETs and an ss corner has slow characteristics for both p-channel and n-channel FETs. A fs corner has fast n-channel FETs and slow p-channel FETs while an sf corner has slow n-channel FETs and fast p-channel FETs. Speed mismatches of these last types, often referred to as skew lots, are considered to be especially difficult.

FIG. 4A presents current control circuit 600, comprising external temperature insensitive reference voltage source 615, an internal current source, external temperature insensitive resister 604 and an exemplary pixel drive circuit and emissive device comprising p-channel reference current FET 608, large L n-channel bias FET 609, p-channel current source FET 610 and emissive device 611.

Dashed line 622 divides the circuit elements into a part 600 on the left that is the actual current control circuit and a part 625 on the right that represents the circuit elements of a pixel drive circuit.

The current control circuit comprises reference current FET 601, bias FET 602, current source FET 603, bandgap reference voltage circuit 615, thermally insensitive resistor 604, DAC 614, differential amplifier 605, switch FET 606 and current source 607. Reference current FET 601, bias FET 602 and current source FET 603 are formed as part of a monolithic backplane design. Bandgap reference voltage 615 and thermally insensitive resister 604 are part of an external circuit, although it is envisioned that a less effective current control system could be implemented as part of a monolithic backplane design. Differential amplifier 605, switch FET 606 and current source 607 may be implemented in either manner, although differential amplifier 605 and switch FET 606 is easily implemented as part of a monolithic backplane design. The elements of the current control circuit are expected to be present on a backplane in a single instance or, at most, in a few instances, depending on the specifics of the requirements. For example, if more than one $V_{BIAS}$ is required in order to create more than one $V_{REF}$, then a separate circuit would be required for each instance requiring a different $V_{BIAS}$.

The pixel drive circuit elements comprise reference current FET 608, bias FET 609, and current source 610. The input $V_{BIAS}$ to the gate of bias FET 609 is provided by the current control circuit on the left-hand side. Emissive element 611 is not currently implemented part of a monolithic backplane design and is instead taken from a different semiconductor structure. The elements of the pixel drive circuit are replicated for every pixel drive circuit while a single current control circuit may provide current control for all pixel drive circuits.

Current control circuit 600 provides a witness current signal available at connection point 616 as part of a system to enable current control circuit 600 to provide the desired drive current to emissive device 611 at the proper voltage irrespective of temperature. In one embodiment, the exemplary pixel drive circuit is similar to the pixel drive circuit of FIG. 2D. The exemplary pixel drive circuit represents each of the elements of a typical pixel drive circuit in an array of pixel drive circuits. In one embodiment, there may be millions of active pixel drive circuits. In one embodiment, most or all of the pixel drive circuits are organized into identically configured rectangular blocks of pixels comprising a small number of pixel drive circuits, perhaps 10 to 30 although not limited to that range.

P-channel reference current FET 601 and large L n-channel bias FET 602 provide a reference current at a required voltage with output to be mirrored. The source of reference current FET 601 is connected to conductor 612 which delivers V_H to the source of p-channel FETs 601, 603, 606, 608 and 610 and to differential amplifier 605. In one embodiment, V_H is equal to $V_{DDAR}$. The gate of FET 601 is tied to the drain of FET 601, thereby placing FET 601 in diode mode. The gate and drain of FET 601 are connected to the drain of large L n-channel bias FET 602 at node 620, all of which are connected to the gate of current source FET 603. The source of n-channel bias FET 602 is connected to $V_{SS}$ (ground). The gate of bias FET 602 is connected to node 619, which asserts bias voltage $V_{BIAS}$ on the gate of bias FET 602 and on the gate of bias FET 609. Large L n-channel bias FET 602 is operated in saturation and thereby acts as a voltage-controlled resistor with resistance determined by the voltage on its gate.

P-channel current source FET 603 receives the output of the gate and drain of diode connected reference current FET 601 on its gate at the voltage bias level set by bias FET 602. The source of bias FET 602 is connected to 613, which is biased to $V_{SS}$. This in turn asserts a current on its drain at node 616 that is a mirror of the gate and drain of FET 601. The bias level at node 616 is determined by the resistance of external precision resistor 604. Precision resistor 604 is thermally insensitive, with a temperature coefficient of approximately 100 ppm or less over a wide range of temperatures and with a nominal resistance accuracy of 1% or better. One terminal of external precision resistor is connected to $V_{SS}$ over ground 613, and the other terminal is connected to junction point 619.

The current and voltage established at node 616 is asserted on one input to differential amplifier 605. The other input to differential amplifier 605 is an external temperature insensitive reference voltage derived from external band gap voltage reference circuit 615. External band gap voltage reference circuit 615 is configured with a digital output. In one embodiment the operating temperature range of temperature sensor 615 is −40° C. to +125° C. The output is transferred to internal DAC 614 over digital connection 617. In one embodiment, internal DAC 614 is a ratio based resistor DAC with a linear output. Those of skill in the art will recognize that a ratio based resistor DAC is substantially immune to temperature effects. In one embodiment, DAC 614 is an 8-bit DAC with 256 discrete and monotonic voltage levels. In one embodiment, the voltage range of DAC 614 is 0 to 2.08 volts.

The comparison between the voltage applied by DAC 614 and the witness current bias voltage applied from node 616 into differential amplifier 605 creates a servo mechanism operative to change current based on the error signal generated. The output of differential amplifier 605 is applied to the gate of FET 606, which acts as a driver to enable changes to the bias voltage at node 619. The source of FET 606 is connected to conductor 612, which is biased to V_H. FET 606 is a robust p-channel FET that must deliver bias voltage $V_{BIAS}$ to the gate of every large L n-channel FET associated with an active pixel drive circuit. Current source 607 connects to $V_{SS}$ at ground 613. Current source 607 does not need to be robust because it is not required to pass all the current passing through FET 606. The greatest part of the current from FET 606 is delivered to the various large L n-channel bias FETs associated with the active pixels of the array of pixel drive circuits.

P-channel FET 608 and FET 610 form a reference current/current source pair in an exemplary pixel drive circuit with a voltage set by large L n-channel bias FET 609. The voltage at node 619 is asserted on the gate of large L n-channel bias FET 609 which sets the resistance value of bias FET 609 provided it is operated in saturation. The voltage at node 619 is therefore bias voltage $V_{BIAS}$ for large L n-channel bias FET 609. Because it also is connected to large L n-channel bias FET 602, it sets bias FET 602 and bias FET 609 in equilibrium provided p-channel reference current FET 601 is equivalent to p-channel reference current FET 608. The source of n-channel bias FET 609 is connected to $V_{SS}$ over ground 613.

The gate of p-channel reference current FET 608 is connected to its drain, to the drain of large L n-channel reference current FET 609 and to the gate of p-channel current source FET 610 at node 621. When current regulator circuit 600 is in equilibrium, the conditions at node 620 and node 621 will be substantially identical.

The drain of p-channel current source FET 610 connects to the anode of emissive device 611. The cathode of emissive device 611 connects to common cathode return 618. In one embodiment common cathode return 618 is biased to V_L which provides sufficient voltage difference to meet the requirements of emissive device 611 to radiate. In one embodiment, common cathode return 618 is biased to $V_{SS}$. The exemplary pixel is simplified by eliminating the p-channel l_off switch and the data modulation switch previously described with respect to FIG. 2D. All active pixel drive circuits may include those two features.

The exemplary pixel drive circuit of FIG. 4A includes large L n-channel bias FET 609. In an array of active pixel drive circuits, a large L n-channel bias FET may be shared among a number of active pixel drive circuits. In an array of pixel drive circuits based on 4×4 blocks of pixel drive circuits, only one large L n-channel FET may be present and active in each 4×4 block. More than one large L n-channel bias FET may be present and active in each block although the total number active is less than the number of active pixel drive circuits. A block of pixel drive circuits may comprise a different number of pixel drive circuits. For example, each block may be 4×6 pixel drive circuits.

FIG. 4B depicts an arrangement of pixel drive circuits 630 wherein the drains of the mirror circuits of 25 pixels are shorted together to provide a witness sample after that of node 616 of circuit 600 of FIG. 4A. In the case of FIG. 3D where each conductive mounting plate can receive the output of 25 pixel current mirror drive circuits, the witness sample should combine the outputs of 25 pixel drive circuits. It is foreseen that the witness sample should have the same number of circuits as each conductive mounting plate. In cases where this is not feasible, a ratio arrangement can be used.

Arrangement of pixel drive circuits 630 depicts two 4×4 blocks arranged side by side each with 16 pixel drive circuits annotated A and B. Block A comprises pixel drive circuits A(0,0)-A(3,3) and block B comprises pixel drive circuits B(0,0)-B(3,3). The pixel locations to be used for the witness current port in this instance are shaded. Other pixel drive circuit physical layouts are envisioned for the witness current port.

Figure 4C:
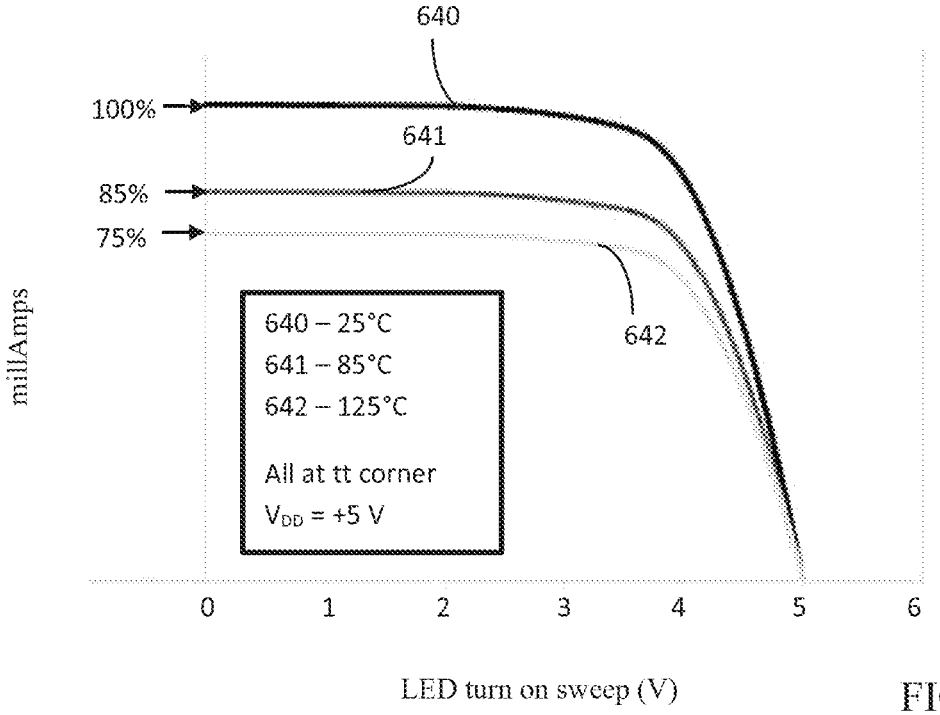
FIGS. 4C and 4D depict the effects of temperature on the current of a pixel drive circuit of the present invention.
Figure 4D:
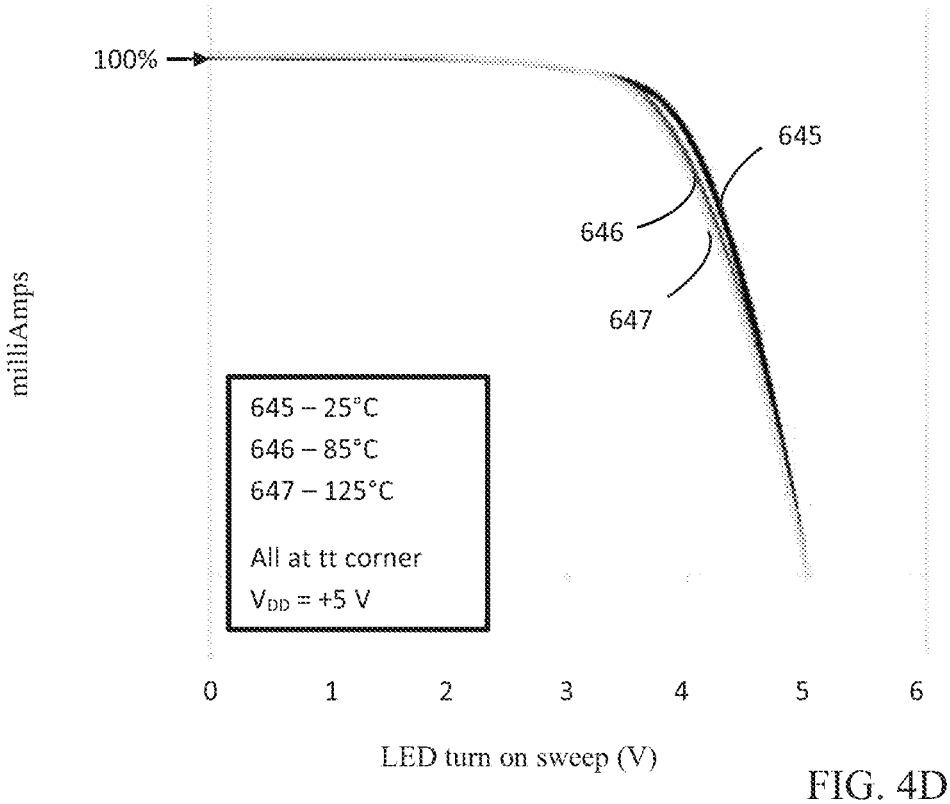

FIGS. 4C and 4D illustrate the effects of temperature on a circuit supplying current to an LED pixel. In the example of FIG. 3B, there are as many as 25 parallel pixel drive circuits delivering current to the mounting plate upon which the LED is placed.

FIG. 4C depicts I-V modeling data for the current output to an LED pixel mounted to a backplane as described herein at three different temperatures without the use of a current control circuit. Each of the curves represents a voltage sweep over the range of 0 to 5 volts with $V_{DD}$=5 volts. The current diminishes as temperature increases. Current curve 640 at 25° C. is considered nominal and is rated at 100% of desired current. At 85° C. current curve 641 is 85% of nominal and at 125° C. current curve 642 to each LED pixel is 75% of nominal at 25° C. The result of a reduced current is obviously a reduced output. Since temperature is not controlled, it is important to use devices such as the circuit of FIG. 4A.

FIG. 4D depicts I-V modeling data for the current output to an LED pixel mounted to a backplane as described herein at three different temperatures wherein a current control circuit such as that for FIG. 4A is used. Current curve 645 for 25° C., current curve 646 for 85° C. and current curve 647 for 125° C. now substantially overlay one another in the saturation region between 0 and 3 volts. In the region between 3 and 5 volts the curves are offset a small amount. By inspection, it is clear that the current is relatively stable over the range of temperatures from 25° C. to 125° C. The reduced current effect due to temperature of FIG. 4C is strongly mitigated.

Figure 4E:
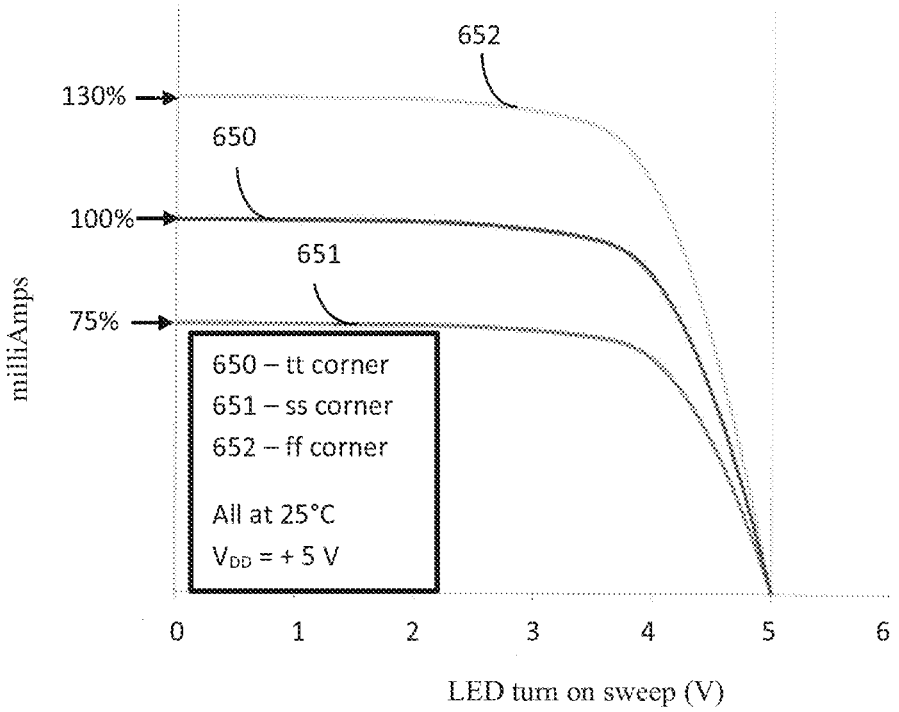
FIGS. 4E and 4F depict I-V modeling data for the current output to an LED pixel mounted to a backplane at 25° C. for three different process corners.
Figure 4F:
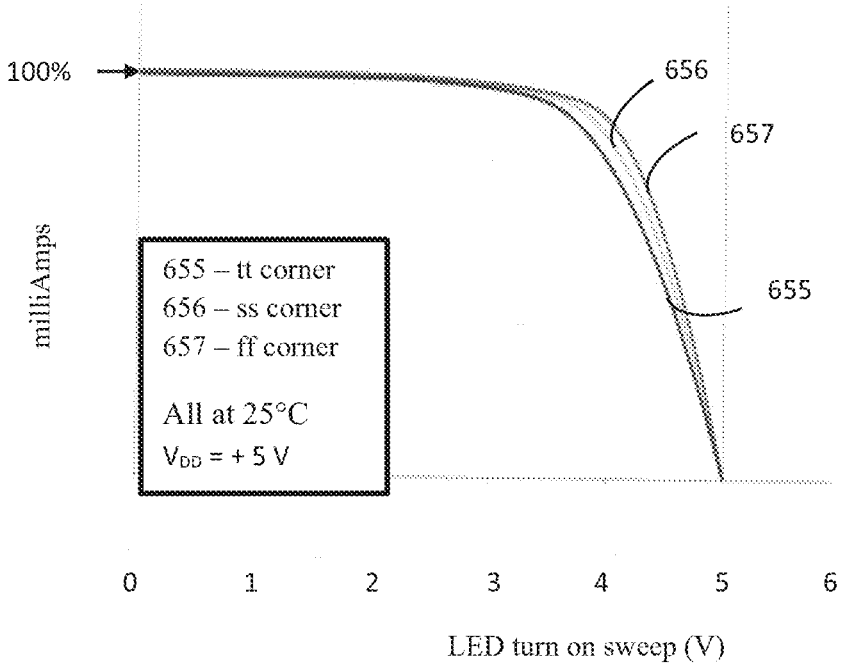

Another important effect on the current performance of individual instances of a backplane is the previously mentioned process variation. FIGS. 4E and 4F depicts I-V modeling data for the current output to an LED pixel mounted to a backplane at 25° C. for three different process corners, the tt corner, the ss corner and the ff corner. Each of the curves represents a voltage sweep over the range of 0 to 5 volts with $V_{DD}$=5 volts.

FIG. 4E presents current data for the three process corners when no current control circuit such as that of FIG. 4A is used. Current curve 650 for the tt process corner is considered nominal and is rated at 100% of desired current. Current curve 651 for the ss process corner is 75% of nominal and current curve 652 at the ff process corner is rated at 130% of nominal. This wide range of current values would require substantial culling of parts to arrive at a consistent set of devices absent some mechanism for controlling current.

FIG. 4F depicts I-V modeling data for the three process corners with the current control circuit such as that for FIG. 4A in operation. Tt current curve 655, ss current curve 656 and ff current curve 657 now overlay one another substantially in the saturation region of 0 to 3 volts and are reasonably close in the linear region of 3 to 5 volts. This is now quite reasonable performance and represents a significant step that can lower costs by increasing the range of acceptable performance for parts within the process corners.

Those of skill in the art will recognize that in some applications it will be necessary to compensate for process variation and for temperature change in the same component. The present circuit is clearly able to perform both tasks at the same time.

There is also a downward shift in efficiency of LEDs as junction temperature rises, so it is important for lighting designers to include some level of thermal management in designs. One approach is to decide on a terminal operating temperature that yields a desired light output from temperature sensitive light sources like LEDs. The light output from LEDs diminishes as the junction temperature rises. This is perhaps related to ambient temperature to a degree but is not necessarily the same as the operating temperature may be higher due to internal heating.

While this disclosure has been described by way of example, and in terms of embodiments, it is to be understood that the present disclosure is not limited to the disclosed embodiments. To the contrary, it is intended to cover various modifications and similar arrangements that would be apparent to those skilled in the art. Therefore, the scope of the appended claims should be accorded the widest possible interpretation so as to encompass all such modifications and similar arrangements.

What is claimed is:

1. An array of emissive pixel drive elements operative to provide a pulse width modulated current at a required voltage to an array of emissive elements, and wherein each pixel element comprises a binary memory cell operative to enable provision of the pulse width modulated current when set to a first memory state and to disenable provision of the pulse width modulated current when set to a second memory state, and wherein a plurality of individual contiguous pixel drive elements form a group configured to connect in parallel provide the pulse width modulated current to a single conductive pad element, wherein the single conductive pad element is configured to act as a mounting pad for a single emissive element.

2. The array of emissive pixel drive elements of claim 1, wherein a selection of pixel drive elements comprises a block spanning a first number of columns comprising a plurality of columns and spanning a second number of rows comprising a plurality of rows, wherein the block of pixel drive elements is designed as a unit that is replicated across the array of emissive pixel elements.

3. The array of emissive pixel drive elements of claim 2, wherein a block of pixel drive elements comprises a part of the pixel drive elements configured to connect in parallel to a single conductive mounting pad.

4. The array of emissive pixel drive elements of claim 2, wherein a part of the drive elements of a block of pixel drive elements connect to a first conductive pad and a part of the pixel drive elements of the same block of pixel drive elements connect to a second conductive pad.

5. The array of emissive pixel drive elements of claim 1, wherein at least one pixel drive element connected to a conductive pad is electrically disconnected from that conductive pad by a metal mask change, and wherein the number of pixel drive elements disconnected from each conductive pad of the array of emissive pixel elements is the same.

6. The array of emissive pixel elements of claim 1, wherein the number of pixel drive elements disconnected from a first conductive pad is different to the number of pixel drive elements disconnected from a second conductive pad, and wherein a portion of the emissive pixel drive elements disconnected from a conductive pad are disconnected through a metal mask change and a portion of the emissive pixel drive elements disconnected from a conductive pad are disconnected through the provision of data to the memory cell of that pixel drive elements of a data state that disenables the provision of that data.

* * * * *